US011806839B2

(12) United States Patent
Miller, Jr. et al.

(10) Patent No.: US 11,806,839 B2
(45) Date of Patent: Nov. 7, 2023

(54) KNIFE SHARPENING SYSTEMS

(71) Applicant: SharkNinja Operating LLC, Needham, MA (US)

(72) Inventors: Eric Arthur Miller, Jr., Somerville, MA (US); Nathaniel R. Lavins, Cambridge, MA (US); Joshua D. Anthony, N. Billerica, MA (US); Orlando Soto, Amesbury, MA (US); Ross Richardson, Sherborn, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 17/394,156

(22) Filed: Aug. 4, 2021

(65) Prior Publication Data

US 2022/0288746 A1 Sep. 15, 2022

Related U.S. Application Data

(63) Continuation of application No. 17/196,348, filed on Mar. 9, 2021, now Pat. No. 11,376,713.

(51) Int. Cl.
*B24D 15/08* (2006.01)
*B24B 3/54* (2006.01)

(52) U.S. Cl.
CPC ..... *B24D 15/081* (2013.01); *B24B 3/54* (2013.01)

(58) Field of Classification Search
CPC ..... B24D 15/081; B24D 15/08; B24B 3/54; B26B 29/025
USPC ..... 83/174; 451/555, 164; 30/138; 76/86
See application file for complete search history.

(56) References Cited

U.S. PATENT DOCUMENTS 1,262,073 A 4/1918 McCain
1,386,001 A 8/1921 E. Jacobs
2,351,438 A * 6/1944 Levy ..... B24D 15/085 451/164
2,528,943 A 11/1950 Calabrese
(Continued)

FOREIGN PATENT DOCUMENTS

CN 2862928 Y 1/2007
CN 201108366 Y 9/2008
(Continued)

OTHER PUBLICATIONS

International Search Report and Written Opinion for PCT Application No. PCT/US2022/019571, dated Aug. 5, 2022, 17 pages.
(Continued)

*Primary Examiner* — Nhat Chieu Q Do
(74) *Attorney, Agent, or Firm* — MINTZ LEVIN COHN FERRIS GLOVSKY AND POPEO, PC

(57) ABSTRACT

Knife sharpener systems and methods are provided. In one exemplary embodiment, a knife sharpening system can include a housing configured to receive a knife blade at a proximal end thereof and a sharpening element movably mounted to the housing and configured to sharpen a cutting edge of a knife blade by moving relative to the housing along and against a cutting edge of a knife blade disposed in the housing. The knife sharpening system can include an access door pivotally coupled to a distal end of the housing and configured to allow access to the sharpening element to allow removal of at least a portion of the sharpening element.

6 Claims, 20 Drawing Sheets

(56) References Cited

U.S. PATENT DOCUMENTS

| | | | | |
|---|---|---|---|---|
| 3,339,313 | A * | 9/1967 | Lindhag | B24D 15/085 451/558 |
| 3,676,961 | A | 7/1972 | Jackson | |
| 3,774,350 | A | 11/1973 | Bayly | |
| 4,041,651 | A | 8/1977 | Bayly | |
| 4,091,691 | A * | 5/1978 | Bayly | B24D 15/084 76/86 |
| 4,117,748 | A | 10/1978 | Watts | |
| 4,604,836 | A | 8/1986 | Huang | |
| 4,654,968 | A * | 4/1987 | Gatley | B26B 29/025 76/86 |
| 4,693,439 | A | 9/1987 | Hahn | |
| 4,729,191 | A | 3/1988 | Meyer et al. | |
| 4,794,738 | A | 1/1989 | Brignoli | |
| 4,866,845 | A | 9/1989 | Mcevily | |
| 4,869,027 | A | 9/1989 | Mcevily | |
| 5,009,040 | A | 4/1991 | Petroff | |
| 5,315,761 | A | 5/1994 | Norton et al. | |
| 6,117,002 | A | 9/2000 | Stokes et al. | |
| 6,267,652 | B1 | 7/2001 | Friel, Sr. et al. | |
| 6,726,551 | B2 | 4/2004 | Friel, Sr. | |
| 6,805,619 | B2 | 10/2004 | Carbone | |
| 6,863,600 | B2 | 3/2005 | Friel, Sr. | |
| D517,891 | S | 3/2006 | Tsuchida | |
| 7,235,004 | B2 | 6/2007 | Friel et al. | |
| 7,494,403 | B2 | 2/2009 | Friel, Sr. | |
| 7,517,275 | B2 | 4/2009 | Friel, Sr. et al. | |
| 7,637,803 | B2 | 12/2009 | Welch | |
| 7,686,676 | B2 | 3/2010 | Friel, Sr. et al. | |
| 8,430,720 | B2 | 4/2013 | Friel et al. | |
| 8,491,356 | B2 | 7/2013 | Walker | |
| 8,590,427 | B2 | 11/2013 | Murphy et al. | |
| 8,661,690 | B2 | 3/2014 | Murphy et al. | |
| 8,721,403 | B2 | 5/2014 | Welch | |
| 8,915,766 | B1 | 12/2014 | Kolchin | |
| 9,333,613 | B2 | 5/2016 | Friel et al. | |
| 9,452,508 | B2 | 9/2016 | Beechinor et al. | |
| 9,649,749 | B2 | 5/2017 | Weiner et al. | |
| 9,656,372 | B2 | 5/2017 | Weiner et al. | |
| 9,693,644 | B1 | 7/2017 | Liu et al. | |
| D826,667 | S | 8/2018 | Skeuse et al. | |
| 10,124,458 | B2 | 11/2018 | Dovel | |
| 10,272,535 | B1 | 4/2019 | Lyons et al. | |
| 10,638,863 | B2 | 5/2020 | Liu et al. | |
| 2005/0205506 | A1 | 9/2005 | Siegel | |
| 2008/0173772 | A1 | 7/2008 | Welch | |
| 2012/0266468 | A1 | 10/2012 | Murphy et al. | |
| 2013/0237137 | A1 | 9/2013 | Huff | |
| 2020/0163476 | A1 | 5/2020 | Liu et al. | |
| 2020/0246933 | A1 | 8/2020 | Fowler et al. | |
| 2020/0384611 | A1 | 12/2020 | Wu | |

FOREIGN PATENT DOCUMENTS

| | | | |
|---|---|---|---|
| CN | 201822719 | U | 5/2011 |
| CN | 104274101 | A | 1/2015 |
| CN | 103519721 | B | 7/2015 |
| CN | 205197865 | U | 5/2016 |
| CN | 105212805 | B | 10/2017 |
| CN | 207477426 | U | 6/2018 |
| CN | 104889857 | B | 7/2018 |
| CN | 108356720 | A | 8/2018 |
| CN | 106271914 | B | 11/2018 |
| CN | 109512299 | A | 3/2019 |
| CN | 109571298 | A | 4/2019 |
| CN | 109571299 | A | 4/2019 |
| CN | 108044529 | B | 7/2019 |
| CN | 209412579 | U | 9/2019 |
| CN | 209579267 | U | 11/2019 |
| CN | 209770170 | U | 12/2019 |
| CN | 210354448 | U | 4/2020 |
| CN | 111300174 | A | 6/2020 |
| CN | 211324584 | U | 8/2020 |
| CN | 111702567 | A | 9/2020 |
| CN | 111823067 | A | 10/2020 |
| CN | 211749158 | U | 10/2020 |
| CN | 211911229 | U | 11/2020 |
| CN | 212600658 | U | 2/2021 |
| DE | 102018131332 | A1 | 6/2020 |
| EP | 0665086 | A1 | 8/1995 |
| EP | 1171257 | B1 | 6/2003 |
| EP | 1980364 | B1 | 6/2011 |
| EP | 1748868 | B1 | 3/2012 |
| EP | 3473141 | A1 | 4/2019 |
| EP | 3345515 | B1 | 11/2020 |
| GB | 2529430 | A | 2/2016 |
| GB | 2529430 | B | 7/2018 |
| WO | 02092288 | A2 | 11/2002 |

OTHER PUBLICATIONS

"Operation of Razor Blade Sharpeners", Video. https://www youtube.com/watch?v=YxSqQ8_YsCc&app=desktop, 1 page.

(retrieved on Apr. 29, 2021) "Calphalon Classic Self-Sharpening 6-Piece Cutlery Set", https://www.calphalon.com/en-US/cutlery-and-tools/all-cutlery/self-sharpening-knife-sets/calphalon-classic-self-sharpening-6-pc-cutlery-set-ca-1924554-1, 5 pages.

(retrieved on Apr. 29, 2021) "Chef's Choice Diamond Hone AngleSelect Sharpener Model 1520", https://chefschoice.com/collections/electric-knife-sharpeners/products/chefschoice-diamond-hone-angleselect-sharpener-model-1520, 10 pages.

A.C. Bolding, "How to Sharpen a Cooking Knife Using a Fixed Angle Knife Sharpening, Instructables Workshop" https://www.instructables.com/How-to-Sharpen-a-Cooking-Knife-Using-a-Fixed-Angle/, 6 pages.

"ACCUSHARP® Knife and Tool Sharpeners 2020 Catalog", https://accusharp.com/wp-content/uploads/2020/08/2020-AccuSharp-Catalog-English.pdf, 24 pages.

Amazon.com (retrieved on May 3, 2021) "4-in-1 Kitchen Knife Accessories: 3-Stage Knife Sharpener Helps Repair, Restore and Polish Blades and cut-Resistant Glove", https://www.amazon.com/Kitchen-Knife-Sharpener-Sharpening-Cut-Resistant/dp/B079WWFZY6/ef=sr _ 1_4?crid=1 GYK7GBJSAPPT &dchild=1 &keywords=kitchellence+knif+sharpener&qid=1597851184&s=home-Jarden&sprefix=kitchellcence+%2Cgarden%2C 192&sr= 1-4, 10 pages.

Amazon.com (retrieved on May 3, 2021) "AccuSharp Knife & Tool Sharpener for Sharpening Knives, Cleavers, Axes, Machetes, Serrated Blades, Double Edge Cutting Blade Sharpener", https://www.amazon.com/AccuSharp-ACCU-001C-001C-Knife-Sharpener/dp/B00004VWKQ/ref=sr _ 1_2?dchild= 1 &keywords=accusharp&qid=1597850988&sr=8-2, 13 pages.

Amazon.com (retrieved on May 3, 2021) "Calphalon 321, 12 Piece, Silver", https://www.amazon.com/dp/B011N5YFK6/? ag=097-20 &ascsubtag=v7 3_ 4_7v3_35jh_4_x01_-srt-, 11 pages.

Amazon.com (retrieved on Apr. 29, 2021) "Chefs Choice Trizor XV EdgeSelect Professional Electric Knife Straight and Serrated Knives Diamond Abrasives Patented Sharpening System, 3-stage, Gray", https://www.amazon.com/ChefsChoice-EdgeSelect-Drofessional-Sharpener-Sharpening/dp/BOO 18RSEMU/ref=sr _ 1_2?dchild= 1 &keywords=chef +choice+15xv+knife •sharpening&qid= 1597858821 &sr=8, 11 pages.

Amazon.com (retrieved on May 3, 2021) "Edge Pro Apex 4 Knife Sharpening System", https://www.amazon.com/Edge-Pro-Apex-Sharpening-System/dp/B00BFFY8JI/ref=sr_1_2?dchild=1&keywords=edge+pro+apex+4&qid=1597858920&sr=8-2, 7 pages.

Amazon.com (retrieved on May 3, 2021) "Fiskars, Knife Sharpener with Ceramic Grindstone Roll-Sharp, one Size, Black", https://www.amazon.com/Fiskars-Sharpener-Ceramic-Grindstone-Roll-Sharp/dp/B06XJ2CG2L/ref=sr_1_1?dchild=1&keywords=fiskars+roll+sharpener&qid=1597858067&s=home-garden&sr=1-1, 10 pages.

Amazon.com (retrieved on Apr. 29, 2021) "Joseph Joseph Self Locking Universal Knife Block,Black", https://www.amazon.com/Joseph-Locking-Universal-Knife-Block/dp/B00RLRRXN2, 8 pages.

Amazon.com (retrieved on Apr. 29, 2021) "Lansky 4-Stone Deluxe Diamond System Precision Knife Sharpening Kit", https://www.amazon.com/Lansky-4-Stone-Deluxe-Diamond-Sharpening/dp/

(56) References Cited

OTHER PUBLICATIONS

B000B8L6LS/ref=sr_1_2?dchild=1&keywords=lansky+knife+sharpening&qid=1597858441&sr=8-2, 11 pages.
Amazon.com (retrieved on May 3, 2021) "Mercer Culinary M22608 Millennia 8-Inch Chef's Knife, Black", https://www.amazon.com/Mercer-Culinary-M22608-Millennia-8-Inch/dp/B000PS2XI4, 10 pages.
Amazon.com (retrieved on May 3, 2021) "MLITER Knife Block Without Knives Electric Knife Sharpener UV Knife Sterilizer Stand Holder wiith sterilizing Drying Sharpening Function & Blue LED Indicator 4-in-1 Multi-Knife Care System", https://www.amazon.co.uk/MLITER-Sterilizer-sterilizing-sharpening-Multi-Knife/dp/B075T78LZL, 4 pages.
Amazon.com (retrieved on May 3, 2021) "Official As Seen On TV Bavarian Edge Kitchen Knife Sharpener by BulbHead, Sharpens, Hones, & Polishes Serrated, Beveled, Standard Blades", https://www.amazon.com/Edge-Kitchen-Knife-Sharpener-BulbHead/dp/B077JHX5M1/ref=sr_1_4?dchild=1&keywords=bavarian+edge&qid=1597851275&s=home-garden&sr=1-4, 10 pages.
Amazon.com (retrieved on May 3, 2021) "Presto Professional Electric Knife Sharpener", https://www.amazon.com/Presto-08810-Professional-Electric-Sharpener/dp/B000TYBWJ0/ref=sr_1_1?dchild=1&keywords=presto+eversharp+21-980&qid=1597851415&s=home-garden&sr=1-1, 11 pages.
Amazon.com (retrieved on May 3, 2021) "Rada Cutlery Quick Edge Knife Sharpener", https://www.amazon.com/Rada-Cutlery-Quick-Knife-Sharpener/dp/B001692XPE, 12 pages.
Amazon.com (retrieved on May 3, 2021) "Spyderco Tri-Angle Sharpmaker with Safety Rods, Instructional DVD, Two Premium Alumina Ceramic Stone Sets for Blade Repair and Professional-Grade Finishing—204MF", https://www.amazon.com/Spyderco-Tri-Angle-Sharpmaker-Sharpener-204MF/dp/B000Q9C4AE/ref=sr_1_2?dchild=1&keywords=spyderco+knife+sharpening&qid=1597858598&sr=8-2, 10 pages.
Amazon.com (retrieved on May 3, 2021) "SunrisePro Supreme Knife Sharpener—afiladore de cuchillos for all Blade types—Razor Sharp Precision & Perfect Calibration—Easy & Safe to Use—Ideal for Kitchen, Workshop, Craft Rooms, Camping", https://www.amazon.com/SunrisePro-Sharpener-Precision-Calibration-Workshop/dp/B00RW7OYCO, 9 pages.
Amazon.com (retrieved on May 3, 2021) "Farberware 4 Piece steak Knives with Plastic Handles, 4.5", Black", https://www.amazon.com/Farberware-5077242-4-Piece-Stainless-Plastic/dp/B007XLLLE8/ref=pd_lpo_79_t_0/147-6384382-2305249?_encoding=UTF8&pd_rd_i=B007XLLLE8&pd_rd_r=ee1d358cd2cf-4de8b1e2-33603d8488fe&pd_rd_w=WzuS2&pd_rd_wg=b8vu4&pf_rd_p=7b36d496f366-4631-94d3-61b87b52511b&pf_rd_r=D1CKPT08WZM66RNQ7QZ3&psc=1&refRID=D1CKPT08WZM66RNQ7QZ3.
Amazon.com (retrieved on Apr. 29, 2021) "Wicked Edge Gen 3 Pro—Precision Knife Sharpener", https://www.amazon.com/Wicked-Edge-Generation-3-Pro/dp/B073W21WNG, 8 pages.
Amazon.com (retrieved on May 3, 2021) "Work Sharp Knife & Tool Sharpener", https://www.amazon.com/Work-Sharp-WSKTS-Sharpening-Repeatable/dp/B003IT5F14/ref=sr_1_2?dchild=1&keywords=worksharp+knife+sharpener&qid=1597851518&s=home-garden&sr=1-2, 12 pages.
"Automatic Knife Sharpening Robot" Video. https://www.youtube.com/watch?app=desktop&v=FwfqU7B4FtY, 1 page.
(Jan. 30, 2020) "The Inspired Home Show 2020 Preview",Brush Expert, https://www.brushexpert.com/getdoc/inspired%20home%202020/2020%20show%20preview%20product%20catalog.pdf, 24 pages.
(retrieved on May 3, 2021) "CATRAHONE Diamond Power Knife Sharpener", CATRA, https://www.catra.org/sharpening-products/catrahone-domestic-sharpener/, 7 pages.
(retrieved on May 3, 2021) "Chefs Choice Trizor XV Sharpener EdgeSelect Model 15", https://chefschoice.com/products/chefschoice-trizor-xv-sharpener-edgeselect-model-16, 15 pages.
Kolh's (retrieved on Apr. 29, 2021) "Craft Kitchen ExactEdge 13-pc. Stainless Steel Knife Block Set", https://www.kohls.com/product/prd-4397815/craft-kitchen-exactedge-13-pc-stainless-steel-knife-block-set.jsp, 4 pages.
(retrieved on Apr. 29, 2021) "Craft Kitchen Stainless Steel 13 Piece Knife Block Set", https://www.wayfair.com/kitchen-tabletop/pdp/craft-kitchen-stainless-steel-13-piece-knife-block-set-crkt1124.html, 6 pages.
(retrieved on Apr. 29, 2021) "CraftKitchen Exact Edge 13pc Self-Sharpening Cutlery Set", https://www.target.com/p/craftkitchen-exact-edge-13pc-self-sharpening-cutlery-set/-/A-80178093, 6 pages.
"Apex 4 Fit—Apex Model Edge Pro Sharpening System", https://www.edgeproinc.com/Apex-4-Kit-Apex-Model-Edge-Pro-Sharpening-System-p7.html, 4 pages.
Fiskars, "Essential Roll-Sharp" https://www.fiskars.eu/products/cooking/knives-accessories/essential-roll-sharp-1023811, 4 pages.
(retrieved on Apr. 29, 2021) "Farberware Edgekeeper 5 Piece Knife Block Set with Built in Sharpener", https://www.target.com/p/farberware-edgekeeper-5-piece-knife-block-set-with-built-in-sharpener/-/A-76422185, 7 pages.
Bright Time Industrial Limited (retrieved on Dec. 29, 2020) "Germicidal UV Knife Block with Built in Electric Sharpener 192(L) 188(W) 245(H) mm", http://www.ceramicsteelknife.com/sale-11242350-germicidal-uv-knife-block-with-built-in-electric-sharpener-192-l-188-w-245-h-mm.html, 2 pages.
(retrieved on Apr. 29, 2021) "Indiegogo Mliter S20 Multi-functional Knife Care System", https://www.indiegogo.com/projects/mliter-s20-multi-functional-knife-care-systern#/, 5 pages.
(retrieved on Apr. 29, 2021), "MinoSharp", https://www.sointuusa.com/brand_minosharp/, 3 pages.
(retrieved Apr. 29, 2021) "New England Cutlery 7 Piece Stainless Steel Cutlery Knife Block Set", https://www.wayfair.com/kitchen-tabletop/pdp/new-england-cutlery-7-piece-stainless-steel-cutlery-knife-block-set-nwen1017.html, 6 pages.
(retrieved May 10, 2021) "Quick Edge Knife Sharpener", https://radakitchenstore.com/products/quick-edge-knife-sharpener, 5 pages.
"Resharp Quickly Restores Knives to a Factory Edge", https://www.resharp.com/, 4 pages.
(retrieved Apr. 29, 2021) "Small KS5", https://www.fazzinitechnology.com/en/small-ks5.aspx, 4 pages.
Sparkx (retrieved on May 3, 2021) "Elevate Your Performance", https://www.sparxhockey.com/, 11 pages.
Spyderco, "Tri-Angle Sharpmaker 204 MF", https://www.spyderco.com/catalog/details.php?product=77, 5 pages.
Wikipedia (retrieved on May 3, 2021) "Sharpening Stone", https://en.wikipedia.org/wiki/Sharpening_stone, 6 pages.
"Which Knife Sharpener is Best?" Let's find out! Video. https://www.youtube.com/watchv=KBINMUdIJ14&ab_channel=ProjectFarm. 1 page.
(2017) Wicked Edge Precision Knife Sharpeners Instruction Manual for Model WE100, https://cdn.shopify.com/s/files/1/1477/6356/files/WE_100_Manual_Web.pdf?2553740767470582169&_ga=2.72508688.2043718499.1498491180-1456909663.1498491180. 28 pages.
(retrieved Apr. 29, 2021) "Wicked Edge Precision Knife Sharpeners", https://wickededgeusa.com/, 6 pages.

* cited by examiner

KNIFE SHARPENING SYSTEMS

CROSS-REFERENCE TO RELATED APPLICATIONS

The present application is a continuation of U.S. patent application Ser. No. 17/196,348, filed Mar. 9, 2021, and entitled "Knife Sharpening Systems," which is incorporated herein by reference in its entirety.

FIELD

Knife sharpening systems and methods are provided.

BACKGROUND

A knife's utility generally depends on the sharpness of the cutting edge of its blade. The cutting edge of most blades, however, eventually becomes dull through repeated use. A wide range of use conditions can contribute, and in some instances accelerate, the dulling of the cutting edge. As a result, in order to maintain an effective cutting edge, and thus prolong the useful life of the knife, the blade must be sharpened periodically. Unfortunately, when purchasing knives, a user typically does not appreciate the need for blade maintenance.

Blade maintenance generally involves honing and sharpening of the blade. Honing involves realigning the cutting edge back to its original position by repeatedly passing the cutting edge across a honing rod at an angle. For honing to be effective in maintaining the cutting edge, a user must regularly hone the blade using a proper honing technique (e.g., positioning the blade at a proper angle and applying an appropriate amount of force to the blade as the user passes the blade along the honing rod). Otherwise, the user can damage the cutting edge in such a way that would require replacement and in certain instances, the user can cause injury to themselves. Unfortunately, most users do not know how to properly hone a blade, find it difficult to do so, or simply do not have the time to regularly hone their knives. Further, even with proper honing, the blade will eventually need to be sharpened.

Sharpening removes material from the blade to produce a new, sharp cutting edge. There are a variety of ways a cutting edge can be sharpened. For example, an end user can send their knives to a professional service for sharpening. However, these services can be expensive and can take long periods of time to sharpen and return the knives. Thus, it is common for a user to purchase an on-demand knife sharpener.

A wide variety of on-demand manual and powered knife sharpeners have been developed (e.g., standalone knife sharpeners or knife sharpeners integrated into knife blocks and cutting boards). With many known manual knife sharpeners, the user is required to place the cutting edge of the blade onto the sharpening surface(s) of the sharpener and, while applying a downward force to the blade, the end user moves the blade against the sharpening surface to sharpen the cutting edge. In other instances, the knife can be affixed and the user can manually move a sharpening surface against the blade. While these knife sharpeners are readily available to the user, their effectiveness in sharpening the cutting edge of a blade relies heavily on the user's applied force and the angle at which the sharpening surface is applied to the blade. Unfortunately, most users are unable to apply, or consistently apply, the proper amount of force to the blade and with the sharpening surface at the proper angle. This can result in inconsistent and unrepeatable sharpening of the cutting edge, and in some situations, can cause damage to the cutting edge (e.g., chipping) that could therefore require replacement. Further, when using most knife sharpeners, the user can be exposed to the cutting edge of the blade, and as a result, this can increase the risk for user injury. Powered knife sharpeners are also available, however these can be highly complex and very expensive. Some still require the user to apply a downward force to the blade so that the blade will remain in contact with the sharpening surface as it moves against the blade. Other more complex powered knife sharpeners require complicated electronics as well sensing systems that can detect the profile of the blade to allow the sharpening surface to automatically move along the blade. These systems can also be fairly bulky, making storage undesirable.

Accordingly, despite existing technologies, there remains a need for improved knife sharpeners that is easy to use and that can consistently and repeatedly sharpen a knife.

SUMMARY

Knife sharpener systems and methods for sharpening knifes are provided. In one embodiment, a knife sharpener is provided and includes a support structure configured to hold a knife having a handle and a blade extending therefrom, and a carriage assembly mounted on the support structure and having a sharpening element configured to sharpen a cutting edge of the blade. The carriage assembly is movable in a first direction within a guide track in the support structure to cause the sharpening element to apply a force to the cutting edge of the knife blade.

The carriage assembly can have a variety of configurations. In one embodiment, the carriage assembly is movable in a second opposite direction within the guide track in the support structure, and the sharpening element is configured to be spaced a distance apart from the cutting edge of the knife blade when the carriage assembly is moving in the second direction. In certain aspects, the carriage assembly can include a carriage and an arm pivotally coupled to the carriage and having the sharpening element mounted thereon. The sharpening element can be spring-biased toward the cutting edge of the knife blade to provide a substantially constant force to the cutting edge of the knife blade when the carriage assembly is moved in the first direction. The arm can be configured to move along a return track in the housing when the carriage assembly is moved in a second opposite direction. The knife sharpener system can also include a pawl mounted to the support structure and configured to move the arm into the return track when the carriage assembly switches from moving in the first direction to moving in the second opposite direction.

In other aspects, the support structure can include a clamping assembly configured to maintain the knife in a fixed position. The clamping assembly can include a pair of jaws configured to engage a portion of the knife. The clamping assembly can also include a release mechanism configured to at least partially separate the jaws to allow the knife to be removed from the clamping assembly.

In another embodiment, the carriage assembly can be configured to automatically advance along the guide track in the first direction. For example, a constant-force spring can be coupled to the carriage assembly and can be configured to control a speed of advancement of the carriage assembly along the guide track in the first direction.

In other aspects, the knife sharpener system can also include a secondary carriage movably disposed in the housing and configured to engage the carriage assembly and move the carriage assembly in a second opposite direction against the force of the spring. The secondary carriage can be configured to automatically release the carriage assembly when the secondary carriage reaches a predetermined position.

In other embodiments, the carriage assembly can include a handle coupled thereto and extending from the housing to allow a user to move the carriage assembly relative to the housing.

In yet another embodiment, a knife sharpener system is provided and includes a clamp assembly configured to hold a knife having a handle and a blade, and a carriage assembly having a carriage, an arm movably coupled to the carriage, and a sharpening element disposed on the arm. The carriage assembly can be movable relative to the clamp assembly and the arm can be spring-biased toward a cutting edge of a blade such that the sharpening element applies a substantially constant force to the cutting edge of the blade as the carriage assembly is moved relative to the clamp assembly.

The carriage assembly can have a variety of configurations. In one aspect, a constant-force spring can be coupled to the arm and can be configured to bias the arm toward a cutting edge of a blade. In another aspect, the carriage can be mounted to a support structure and is movable along a guide track in the support structure.

The sharpening element can also have a variety of configurations. In one embodiment, the sharpening element can be configured to apply a force to a cutting edge of a blade held by the clamp assembly when the carriage assembly is moved in a first direction relative to the blade, and the sharpening element can be configured to be spaced a distance apart from the cutting edge of the blade when the carriage assembly is moved in a second opposite direction relative to the blade.

In other embodiments, the carriage assembly can be configured to be automatically advanced relative to the blade in a first direction. A constant-force spring can be coupled to the carriage assembly and can be configured to control a speed of advancement of the carriage assembly in the first direction.

In another embodiment, a knife sharpener system is provided and includes a housing configured to receive a knife blade, and a sharpening element movably mounted to the housing and configured to sharpen a cutting edge of a knife blade. A position of the sharpening element can be movable relative to the housing such that the sharpening element is configured to adapt to a geometry of the knife blade.

In one embodiment, the knife sharpener can include a biasing element coupled to the sharpening element and configured to spring-bias the sharpening element toward a cutting edge of a knife blade.

In other aspects, the housing can include a clamping assembly configured to maintain the knife blade in a fixed position relative to the sharpening element.

The sharpening system can also include a constant-force spring coupled to the sharpening element and configured to advance the sharpening element along a cutting edge of the knife blade at a substantially constant speed.

In another embodiment, the sharpening element is mounted on an arm that is pivotally coupled to a carriage, and the carriage is movable along a track formed in the housing.

In yet another embodiments, methods for sharpening a knife are provided. In one embodiment, the method can include inserting a knife into a clamping assembly such that the clamping assembly engages the knife to maintain a blade of the knife in a substantially fixed position. The method can further include actuating a sharpening assembly to cause a carriage to travel along a track. The carriage can have a sharpening element movably coupled thereto, and the sharpening element can be biased toward a cutting edge of the knife blade such that the sharpening element can adapt to a shape of the blade as the carriage moves along the track. The sharpening element can apply a substantially constant force to the cutting edge of the blade.

In one embodiment, actuating the sharpening assembly can include moving the carriage in a first direction along the track to cause the sharpening element to travel along the cutting edge of the blade to thereby sharpen the blade, and moving the carriage in a second opposite direction in the track, wherein the sharpening element is spaced apart from the cutting edge of the blade when the carriage is moved in the second opposite direction. The carriage can travel in the track from a position adjacent to the handle to a position beyond a tip of the blade when the carriage is moved in the first direction, and the carriage can be prevented from moving in the second opposite direction until it reaches a predetermined position that is beyond a tip of the blade.

BRIEF DESCRIPTION OF THE DRAWINGS

This invention will be more fully understood from the following detailed description taken in conjunction with the accompanying drawings, in which.

DETAILED DESCRIPTION

Figure 2:
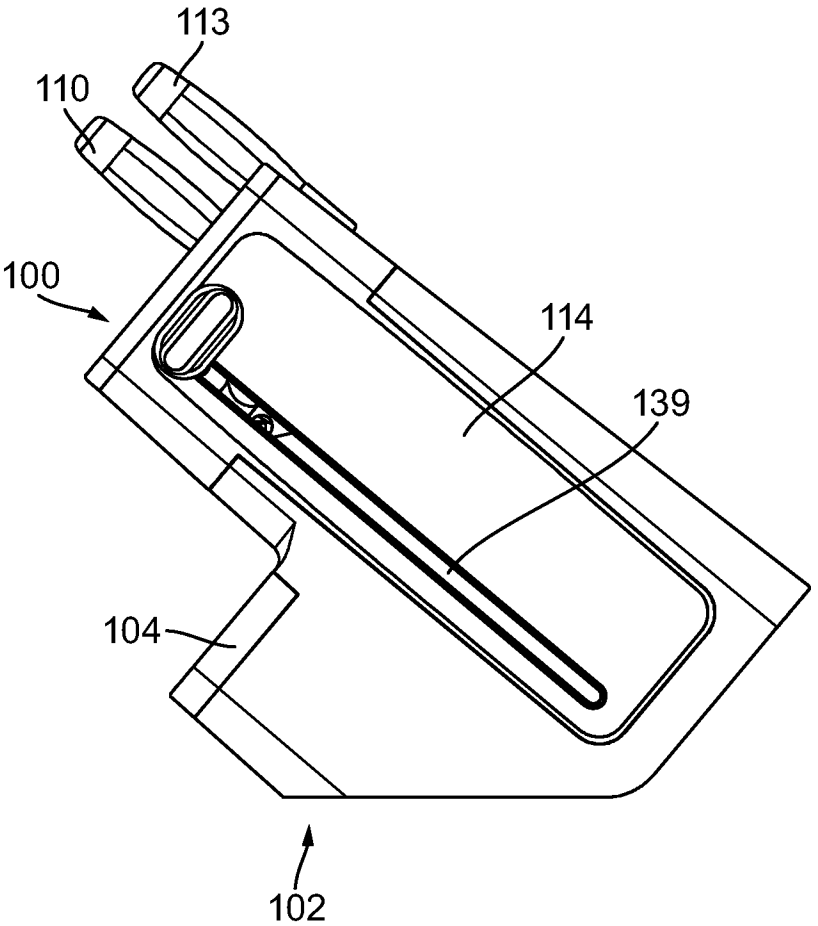
FIG. 2 is a side perspective view of the knife block of FIG. 1.

Certain exemplary embodiments will now be described to provide an overall understanding of the principles of the structure, function, manufacture, and use of the knife sharpening systems and methods disclosed herein. One or more examples of these embodiments are illustrated in the accompanying drawings. Those skilled in the art will understand that the knife sharpening systems and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various knife sharpening systems are provided that are configured to hold a knife while moving a sharpening element relative to an edge of a blade on the knife. As described in more detail below, the knife sharpening systems are configured to provide controlled and reproducible sharpening strokes of the sharpening element along an edge of a blade of the knife during each use, regardless of the shape of the knife. These controlled and reproducible sharpening strokes can allow a user to effectively sharpen a knife blade with repeatability and ease. In certain embodiments, the knife sharpening system can contain the blade within a housing to protect the user from being exposed to the cutting edge during sharpening. Further, in some embodiments, the knife sharpening systems can be integrated into a knife block such that it can be more readily accessible to the user.

An exemplary knife sharpening system can include a variety of features to facilitate sharpening of a knife blade, as described herein and illustrated in the drawings. However, a person skilled in the art will appreciate that the knife sharpening systems can include only some of these features and/or can include a variety of other features known in the art. The knife sharpening systems described herein are merely intended to represent certain exemplary embodiments.

Figure 1:
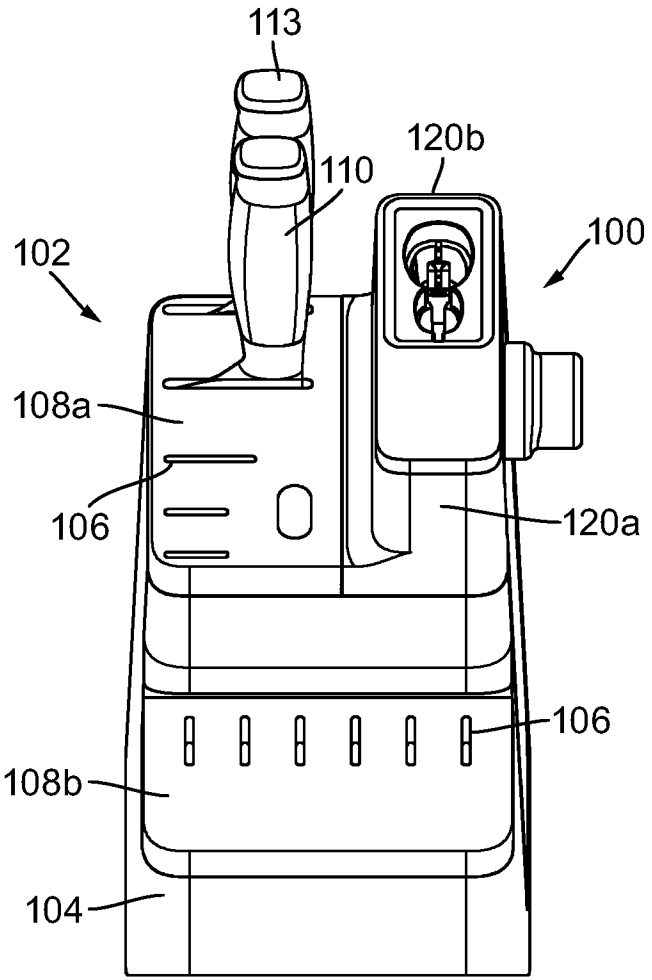
FIG. 1 is a front perspective view of one exemplary embodiment of a knife block having a knife sharpening system therein.
Figure 3:
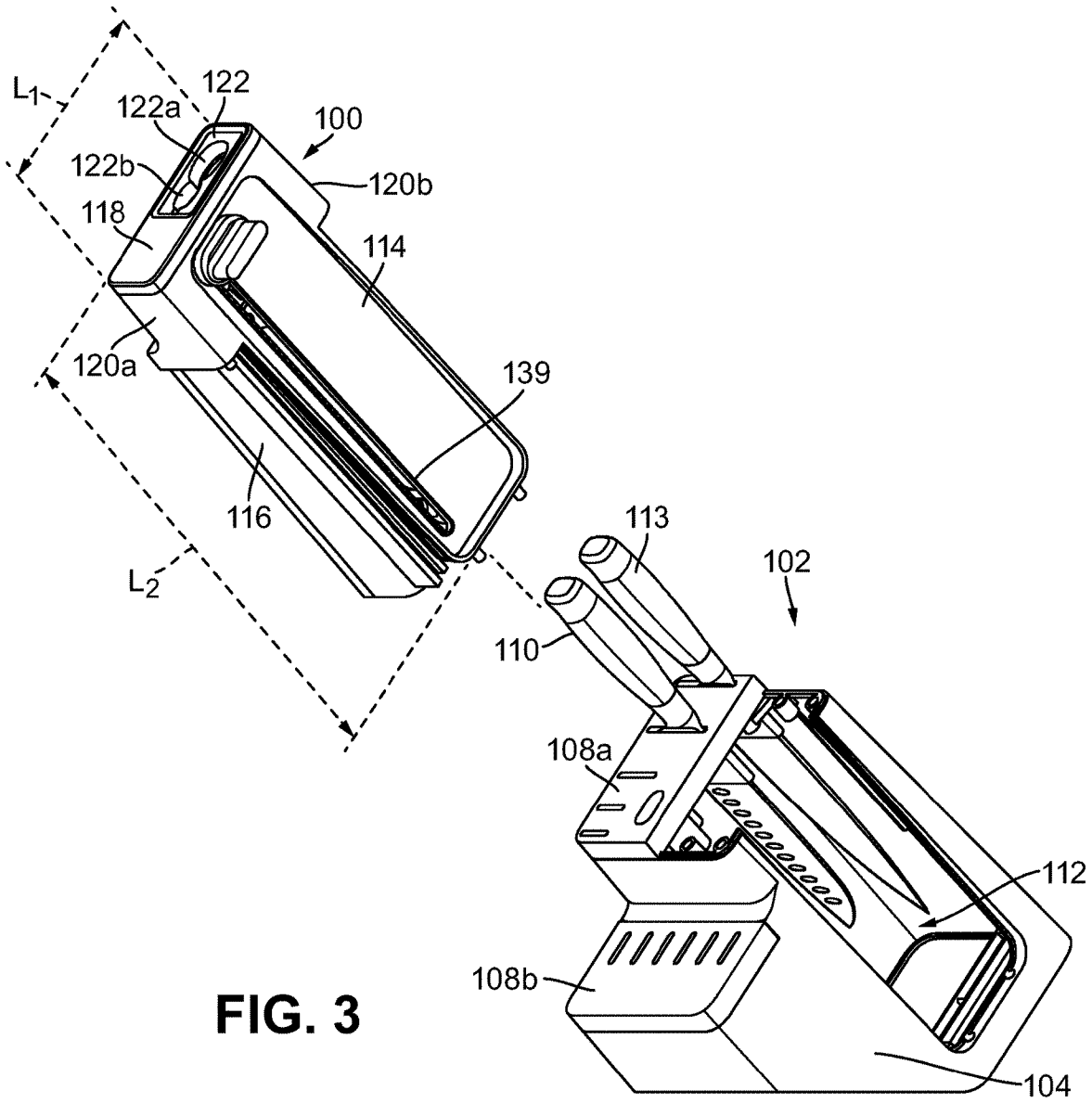
FIG. 3 is a partial exploded perspective view of the knife block of FIG. 1, showing the knife sharpening system removed from the knife block.

FIGS. 1-3 illustrate one exemplary embodiment of a knife sharpening system 100 that is integrated into a knife block 102. The illustrated knife block 102 includes a block body 104 with multiple knife storage slots 106 formed therein. The block body 104 has upper and lower receiving surfaces 108*a*, 108*b* each with an array of knife storage slots 106. Each knife storage slot 106 is configured to receive a blade of a knife (only two knifes 110, 113 are illustrated in FIGS. 1-3). The block body 104 can be formed of a variety of suitable materials such as wood, plastic, metal, or any combinations thereof. A person skilled in the art will appreciate that the block body 104 and knife storage slots 106 can have a variety of shapes and sizes, and therefore, their structural configurations are not limited to what is illustrated in the figures.

As best shown in FIG. 3, the block body 104 includes a cavity 112 that is configured to receive the knife sharpening system 100. This allows the knife sharpening system 100 to be directly built into the block body 104 and allows the knife blades to be sharpened without the user being exposed to their cutting edges. As a result, the knife sharpening system 100 is more readily available and safer to use as compared to existing knife sharpening systems. A person skilled in the art will appreciate that the knife sharpening system 100 can be removable from the knife block 102 or can be entirely separate, and need not be part of the knife block 102.

As shown in FIGS. 3-6, the illustrated knife sharpening system 100 includes a housing defined by a front panel 114, a back panel 116, a top panel 118, and side panels 120*a*, 120*b* that extend therebetween. A person skilled in the art will appreciate that any one or more of the panels can be integral and monolithically formed, and need not be separate structures. Moreover, any one or more of the panels may be omitted, or the knife sharpening system can lack a housing altogether, and instead can include a support structure that is configured to support the components of the knife sharpening system. In the illustrated embodiment, the back panel 116 forms a support structure.

Figure 4:
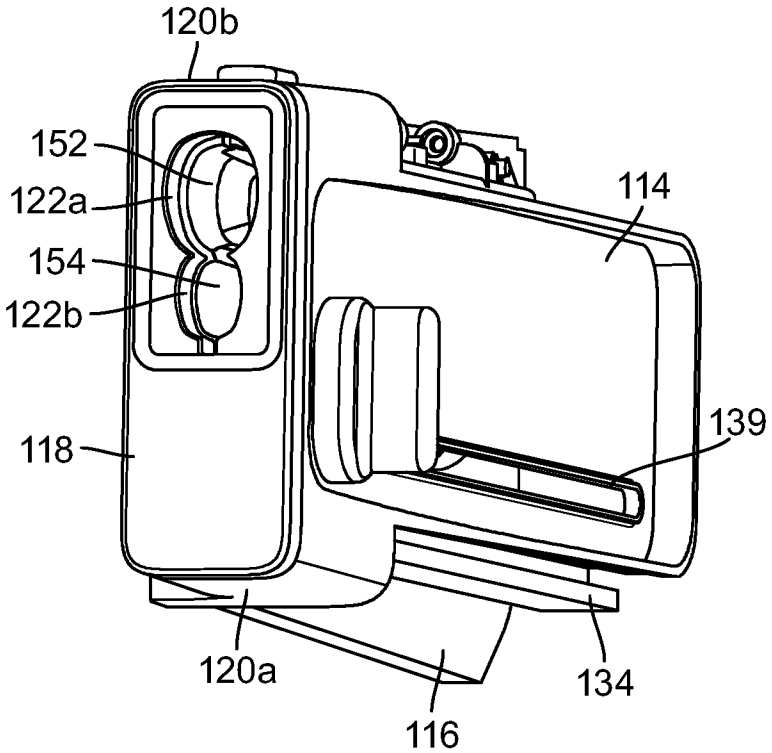
FIG. 4 is a top perspective view of the knife sharpening system of FIG. 3.

As further shown in FIGS. 3-6, the top panel 118 includes an opening 122 that extends longitudinally along a portion of a length Li of the top panel 118 and that allows a knife to be positioned in a clamping assembly, discussed in more detail below. The illustrated opening 122 has two knife slots 122*a*, 122*b*, each configured to receive a knife blade and ultimately engage a portion of a knife handle coupled to the knife blade. While the knife slots 122*a*, 122*b* can have a variety of shapes and sizes, as best shown in FIG. 4, each knife slot 122*a*, 122*b* has an oblong shape to correspond to the shape of the clamping assembly. In other embodiments, the two knife slots 122*a*, 122*b* can have other suitable shapes, such as rectangular, circular, etc. Since the knife sharpening system can be used to sharpen a variety of different sized knives, the first knife slot 122*a* is larger in size than the second knife slot 122*b*, and therefore the first knife slot 122*a* can accommodate and engage with larger knife handles compared to the second knife slot 122*b*. A person skilled in the art will appreciate that the number, size, and shape of the knife slot(s) can vary, and the sharpening system is not limited to the number, size, and shape of the knife slots illustrated in the figures. In certain embodiments, the sharpening system can include a single knife slot. Moreover, as indicated above the knife sharpening system need not include a housing, and thus the clamping assembly can define the openings for receiving one or more knives.

Figure 5:
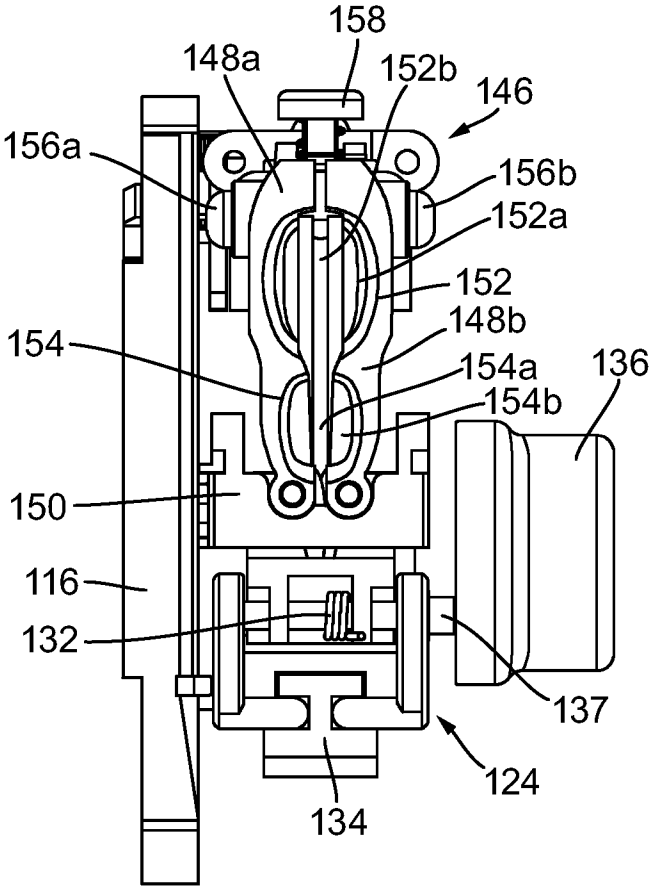
FIG. 5 is a top view of the knife sharpening system of FIG. 4 with certain components removed.
Figure 6:
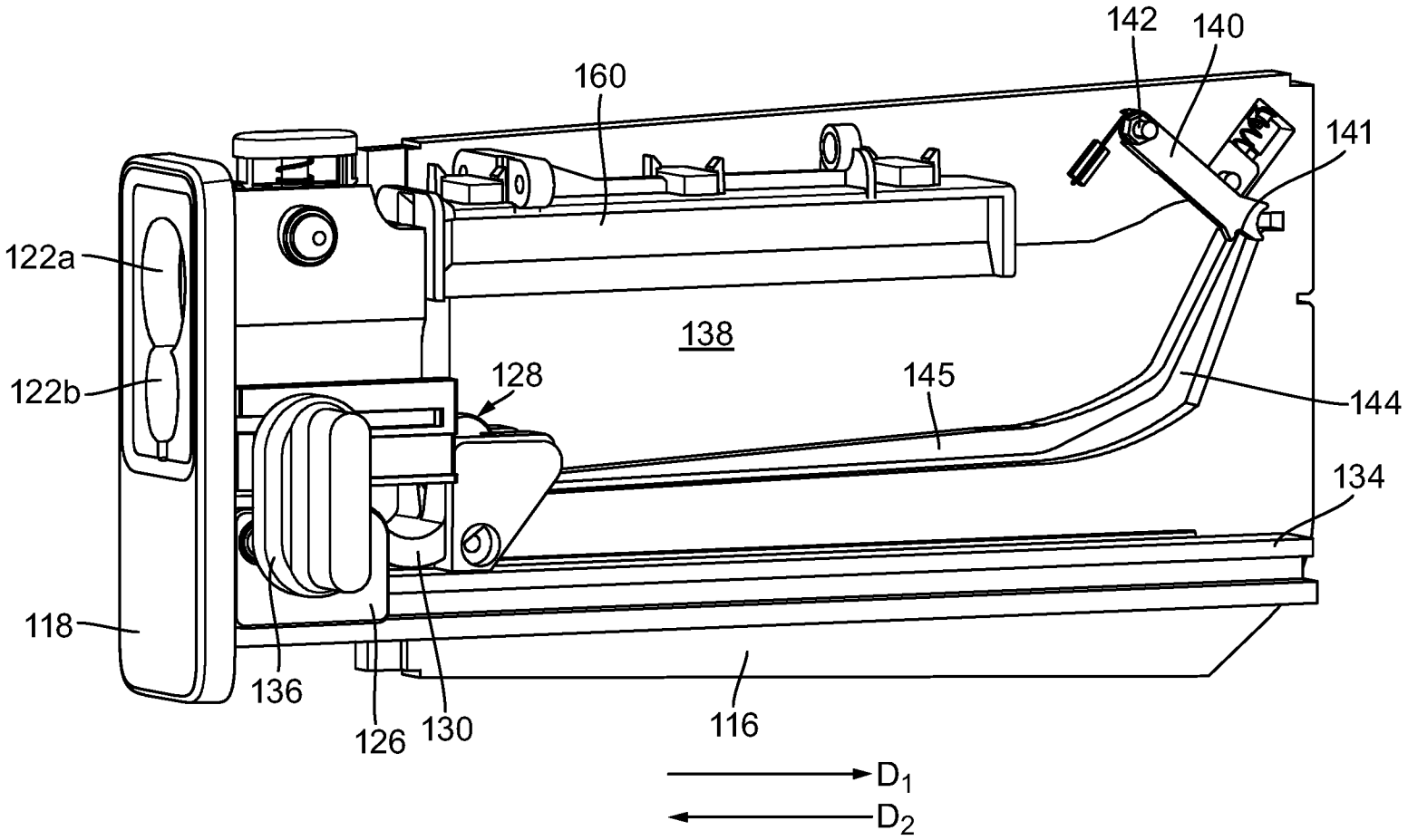
FIG. 6 is a side perspective view of the knife sharpening system of FIG. 4 with certain components removed.
Figure 7:
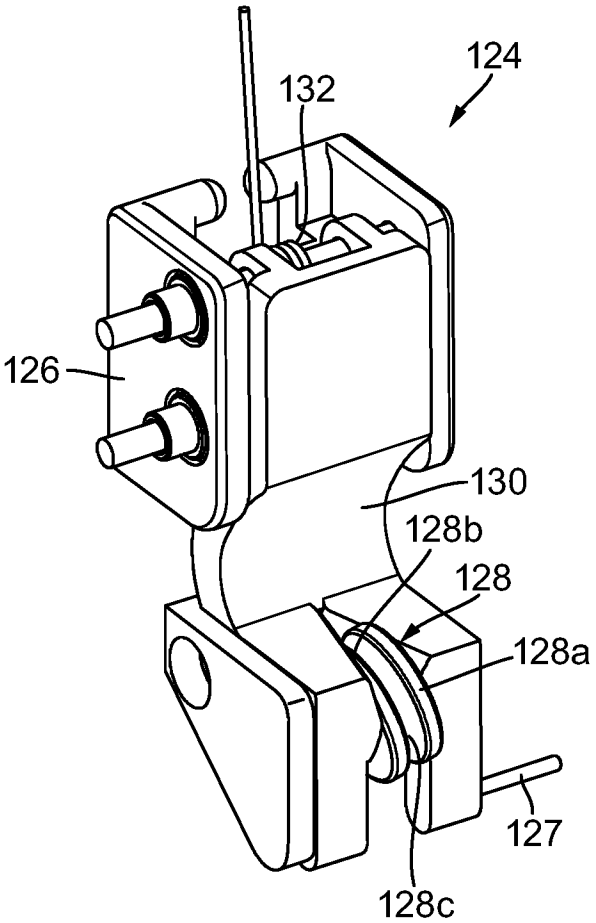
FIG. 7 is a perspective view of a carriage assembly of the knife sharpening system of FIG. 4.

As shown in FIGS. 5-7, the knife sharpening system 100 also includes a carriage assembly 124 movably mounted along the back panel 116, which as indicated above can form a support structure. The carriage assembly 124 includes a carriage 126, an arm 130 movably coupled to the carriage 126, and a sharpening element 128 mounted on the arm 130. The sharpening element 128 is configured to sharpen a cutting edge of a knife blade, such as the cutting edge 110*c* of the knife blade 110*b* shown in FIG. 9, as the carriage assembly moves along the back panel 116. In particular, as shown in FIG. 6, the carriage assembly 124 is configured to move in a first direction $D_1$, in which the sharpening element 128 applies a force to the cutting edge of the knife blade, and in a second opposite direction $D_2$, in which the sharpening element 128 is spaced a distance apart from the cutting edge of the knife blade. The arm 130 also includes a dowel pin 127 (see FIG. 7).

The sharpening element 128 can have a variety of configurations. In this illustrated embodiment, as shown in FIG. 7, the sharpening element 128 is in the form of a rotating wheel with two angled, inner surfaces 128*a*, 128*b* defining a groove 128*c* therebetween. The groove 128*c* is configured to receive a cutting edge of a knife blade to sharpen the sides of the knife blade along its cutting edge. The wheel can be formed of any suitable sharpening material, such as ceramic or diamond. Further, the angle created between the two inner surfaces 128*a*, 128*b* of the wheel can be varied. A variety of other sharpening elements can be utilized, such as a v-groove knife sharpener, and the like. Moreover, the sharpening element can be replaceable to allow for a new sharpening element to be added when the original sharpening element wears out, and/or to allow for different types of sharpening elements to be mounted on the arm. For example, different types of sharpening elements can be used to accommodate knife blade profiles with different sharpening angles.

As indicated above, the sharpening element 128 is mounted to an arm 130 that is pivotally coupled to the carriage 126. In this illustrated embodiment, the arm 130, and thus the sharpening element 128, is biased toward the cutting edge of a knife blade that is disposed within the housing. The biasing force is created by a biasing element 132. While the biasing element 132 can have a variety of configurations, as shown in FIGS. 5 and 7 the biasing element 132 is in the form of a torsion spring. As a result, the sharpening element 128 can provide a substantially constant force to the cutting edge of the knife blade disposed within the housing when the carriage assembly 124 moves in the first direction. Further, with this structural configuration, the sharpening element 128 can accommodate various knife blade sizes and profiles while still providing a substantially constant force to each respective cutting edge. That is, the position of the sharpening element 128 can adapt to a geometry of the knife blade.

As shown in FIGS. 5 and 6, the carriage 126 is slidably disposed within a guide track 134 formed in the back panel 116 of the housing. A handle 136 is coupled to the carriage 126 and extends outward therefrom. As shown in FIG. 5, the handle 136 is coupled to the carriage 126 via dowel pin 137 that extends through a slot 139 defined in the front panel 114 of the housing (see FIGS. 2-4). This allows the handle 136 to be positioned outside of the housing and, thus, easily accessible to a user for actuation of the sharpening element 128. In this illustrated embodiment, the slot 139 extends longitudinally along a portion of a length Lz of the front panel 114. In other embodiments, where a knife sharpening system lacks a housing, the handle can still be coupled to the carriage for allowing ease of use. In use, a user actuates the handle 136 by moving (e.g., pushing) the handle 136 in a first direction (e.g., a distal direction) causing the carriage 126 to travel along the guide track 134 in the same direction. As the carriage 126 travels along the guide track 134, it moves the sharpening element 128 along the cutting edge of a knife blade received within the housing.

Further, as the carriage 126 translates along the guide track 134 in the first direction $D_1$, the arm 130 travels from a home position (shown in FIG. 6) along a first track 138 defined within back panel 116 of the housing. The first track 138 has a width that is large enough to receive the blade of the knife and allow movement of the arm 130. As the arm 130 reaches the end of the first track 138, the dowel pin 127 engages with a pawl 140. As shown in FIG. 6, the pawl 140 is pivotally coupled to the back panel 116 of the housing via a pivot pin 142. The pawl 140 has a first cam surface 141 that is configured to engage with the dowel pin 127 extending outward from the arm 130. Once engaged, the pawl 140 rotates to move the sharpening element 128 from the first track 138 into a return track 144 defined within the back panel 116 of the housing. The first track 138 and return track 144 are separated by a divider in the form of an elongate shelf or protrusion 145.

The return track 144 is designed to inhibit the sharpening element 128 from catching a tip of the knife blade when the sharpening element is retracted or moved in the second direction, and it thus prevents the sharpening element from coming into contact with the cutting edge of the knife blade during movement in the second direction. Since the knife sharpening system 100 is configured to sharpen knife blades of varying lengths, and the sharpening element 128 is configured to be spring-biased toward the cutting edge of the knife blade, once the sharpening element 128 is moved in the first direction past the tip of the knife blade, the spring bias may cause the sharpening element 128 to move above the tip of the knife blade. Retraction in this position would thus cause the sharpening element 128 to catch on the tip of the knife blade, thus preventing return of the sharpening element to the home position. Accordingly, the return track 144 moves the sharpening element 128 downward to space it at a distance apart from the knife blade so that it cannot catch the tip during movement in the second direction. In particular, when the sharpening element 128 is positioned within the return track 144, the user can move (e.g., pull) the handle 136 in a second, opposite direction $D_2$ (FIG. 6). This causes the carriage 126 to move along the guide track 134 in the same direction thereby moving the sharpening element 128 along the return track 144 and back towards its home position. As the sharpening element 128 moves along the return track 144, it is spaced a distance apart from the knife blade, and thus is prevented from coming into contact with the knife blade. As a result, the cutting edge of the knife blade can only be sharpened by the sharpening element 128 when the sharpening element 128 is moved in the first direction.

As indicated above, the knife sharpening system 100 can also include a clamping assembly 146 that is configured to maintain a knife blade in a substantially fixed position relative to the carriage assembly. The clamping assembly 146 can have a variety of configurations. As shown in FIGS.

Figure 8:
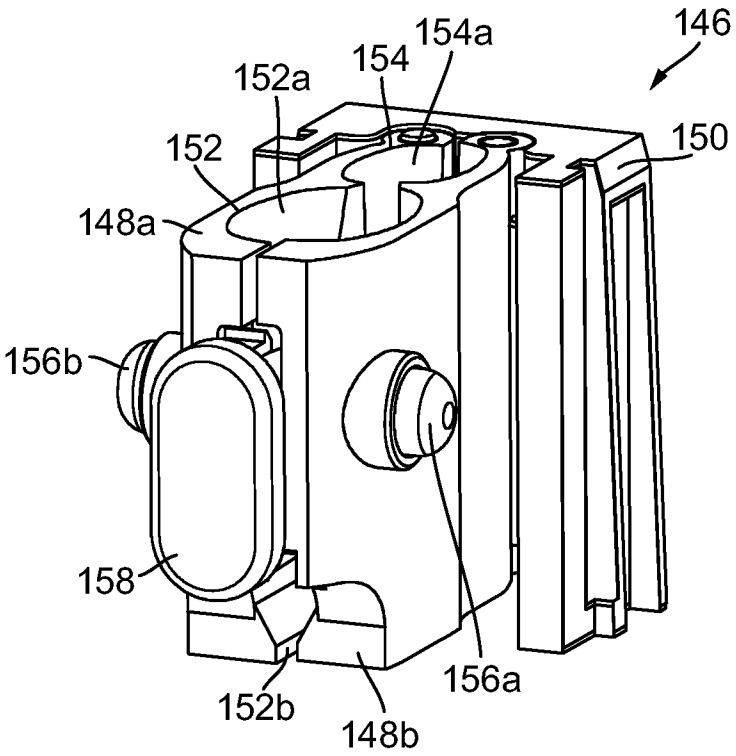
FIG. 8 is a perspective view of a clamping assembly of the knife sharpening system of FIG. 4.

5 and 6, the clamping assembly 146 is positioned proximate to the top panel 118 and includes two jaws 148*a*, 148*b* pivotally coupled to a base member 150. The base member 150 is coupled to and extends between the front and back panels 114 and 116 of the housing. The two jaws 148*a*, 148*b* form first and second openings 152, 154 therebetween that align with the first and second knife slots 122*a*, 122*b*, respectively (see FIG. 4). As shown in FIG. 8, the two openings 152, 154 each have a first portion 152*a*, 154*a* that is configured to engage with a portion of a knife handle, and a second portion (only second portion 152*b* is shown) that is configured to engage with a top portion of the knife blade.

The two jaws 148*a*, 148*b* are biased toward each other via biasing elements 156*a*, 156*b* (e.g., helical springs). As shown in FIG. 5, the first biasing element 156*a* extends between the back panel 116 and the first jaw 148*a*, and the second biasing element 156*b* extends between the front panel (not shown) and the second jaw 148*b*. As a result, when a knife blade is inserted into the housing through the first or second knife slots 122*a*, 122*b*, and thus through the overlapping first or second openings 152, 154 of the clamping assembly 146, an interference fit will be created at least between the jaws 148*a*, 148*b* and the knife blade. This interference fit can help maintain the knife blade in a fixed position within the respective knife slot.

In certain embodiments, the clamping assembly 146 can include a release mechanism configured to at least partially separate the jaws 148*a*, 148*b* to allow a knife blade to be removed from the clamping assembly 146. For example, as shown in FIGS. 5 and 8, the release mechanism is in the form of a release button 158 that is configured to engage and push the two jaws 148*a*, 148*b* apart from each other. In use, to remove a knife blade from the housing, the release button 158 can be actuated (e.g., depressed inward) so as to create a clearance between the jaws 148*a*, 148*b* and the knife blade. This clearance allows the knife blade to be removed from the clamping assembly 146.

Other types of clamping assemblies suitable for use with the present disclosure are described, for example, in UK Patent Application No. GB 2529430, the disclosure of which is incorporated herein by reference in its entirety.

Figure 9:
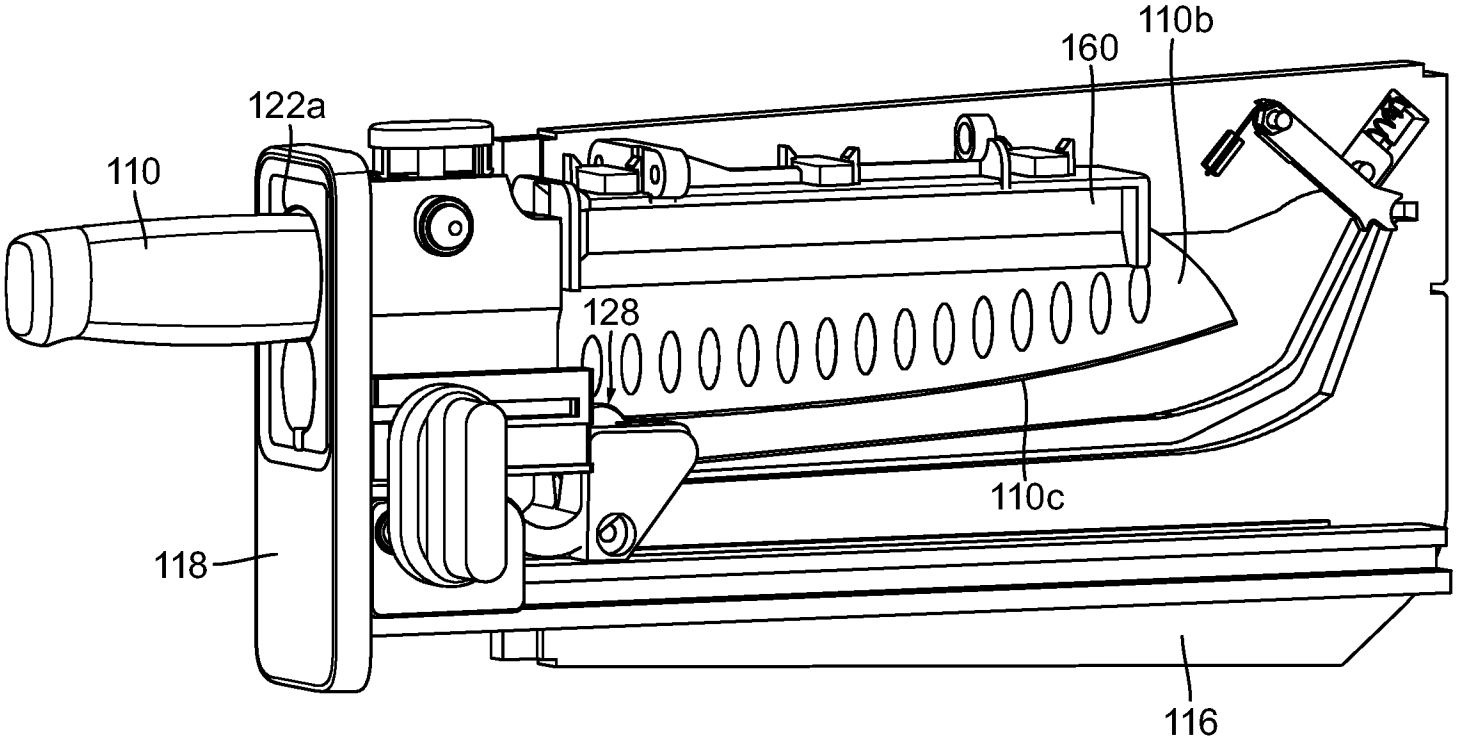
FIG. 9 is a side perspective view of the knife sharpening system of FIG. 6, showing a knife inserted therein.

In some embodiments, the knife sharpening system 100 can also include a knife alignment guide or mechanism. For example, as shown in FIGS. 6 and 9, the knife sharpening system 100 includes a knife alignment guide 160 disposed within the housing. The knife alignment guide 160 is configured to engage with a spine (obstructed) of the knife blade 110*b*, as shown in FIG. 9. This can help further stabilize the knife blade 110*b*.

Figure 10B:
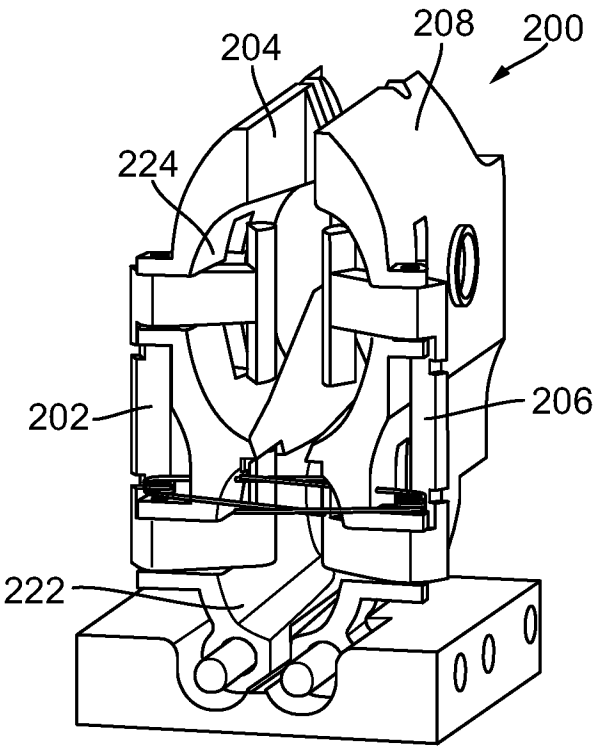
FIG. 10B is a perspective view of the clamping assembly of FIG. 10A, showing the knife alignment mechanism in a second position.
Figure 10A:
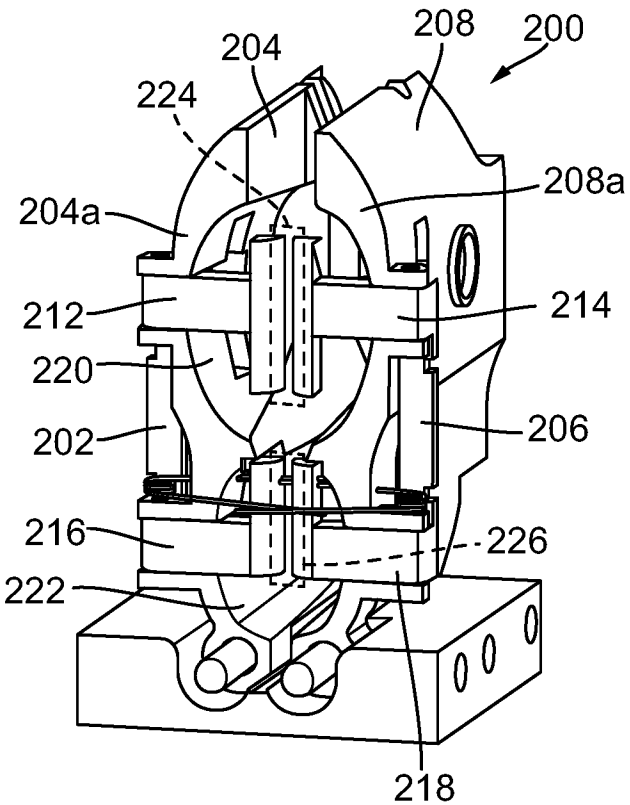
FIG. 10A is a perspective view of an exemplary embodiment of a clamping assembly having a knife alignment mechanism shown in a first position.

In other embodiments, as shown in FIGS. 10A and 10B, a knife alignment mechanism can be incorporated into a clamping assembly 200. The clamping assembly 200 is similar to the clamping assembly 146 shown in FIGS. 5 and 8, and therefore common features are not described in detail herein. The knife alignment mechanism includes a first arm 202 that is pivotally coupled to the top 204*a* of the first jaw 204 of the clamping assembly 200 and a second arm 206 that is pivotally coupled to the top 208*a* of the second jaw 208. Each arm has a T-shaped flange 212, 214 and an L-shaped flange 216, 218 extending therefrom and towards the center of the first and second openings 220, 222 of the clamping assembly 200, respectively. As shown in FIG. 10A, the two T-shaped flanges 212, 214 form a first elongated channel 224 therebetween which is configured to receive and guide a knife blade therethrough. Similarly, the L-shaped flanges 216, 218 form a second elongated channel 226 therebetween which is configured to receive and guide a knife blade therethrough. In use, when a knife blade is inserted into either the first or second elongated channel 224, 226, the arms 202, 206 are configured to pivot inward as shown in FIG. 10B.

FIGS. 11-15 illustrate another embodiment of a knife sharpening system 300 having a housing 302 and a carriage assembly 304 movable disposed within the housing 302. Aside from the differences discussed in detail below, the knife sharpening system 300 is similar to the knife sharpening system 100 shown in FIGS. 1-9, and therefore common features are not discussed in detail herein. For purposes of simplicity, certain components of the knife sharpening system 300 are not illustrated in FIGS. 11-15. Further, while knife blade 326 is illustrated in FIGS. 11-15, a person skilled in the art will appreciate that the knife sharpening system 300 can be used to sharpen a variety of different knife blade sizes and profiles, and therefore the knife sharpening system 300 is not limited to the knife blade size and profile illustrated in the figures.

The carriage assembly 304 in this embodiment includes a primary carriage 306 that is slidably disposed in a first guide track 308, an arm 310 that is pivotally coupled to the primary carriage 306, and a sharpening element 312 that is mounted to the arm 310. The arm 310 and the sharpening element 312 are similar to the arm 130 and the sharpening element 128 shown in FIGS. 6, 7, and 9, and therefore are not described in detail herein. A biasing element 314 is coupled to the primary carriage 306 and is configured to bias the primary carriage 306 to a home position, shown in FIG. 11. The biasing element 314 can have a variety of configurations. In this illustrated embodiment, the biasing element 314 is in the form a constant-force spring that is configured to advance the primary carriage 306 along the first guide track 308 in a first direction $D_1$ (e.g., a distal direction) from a preloaded position (FIG. 12) back to its home position (FIG. 15) at a substantially constant speed.

Figure 11:
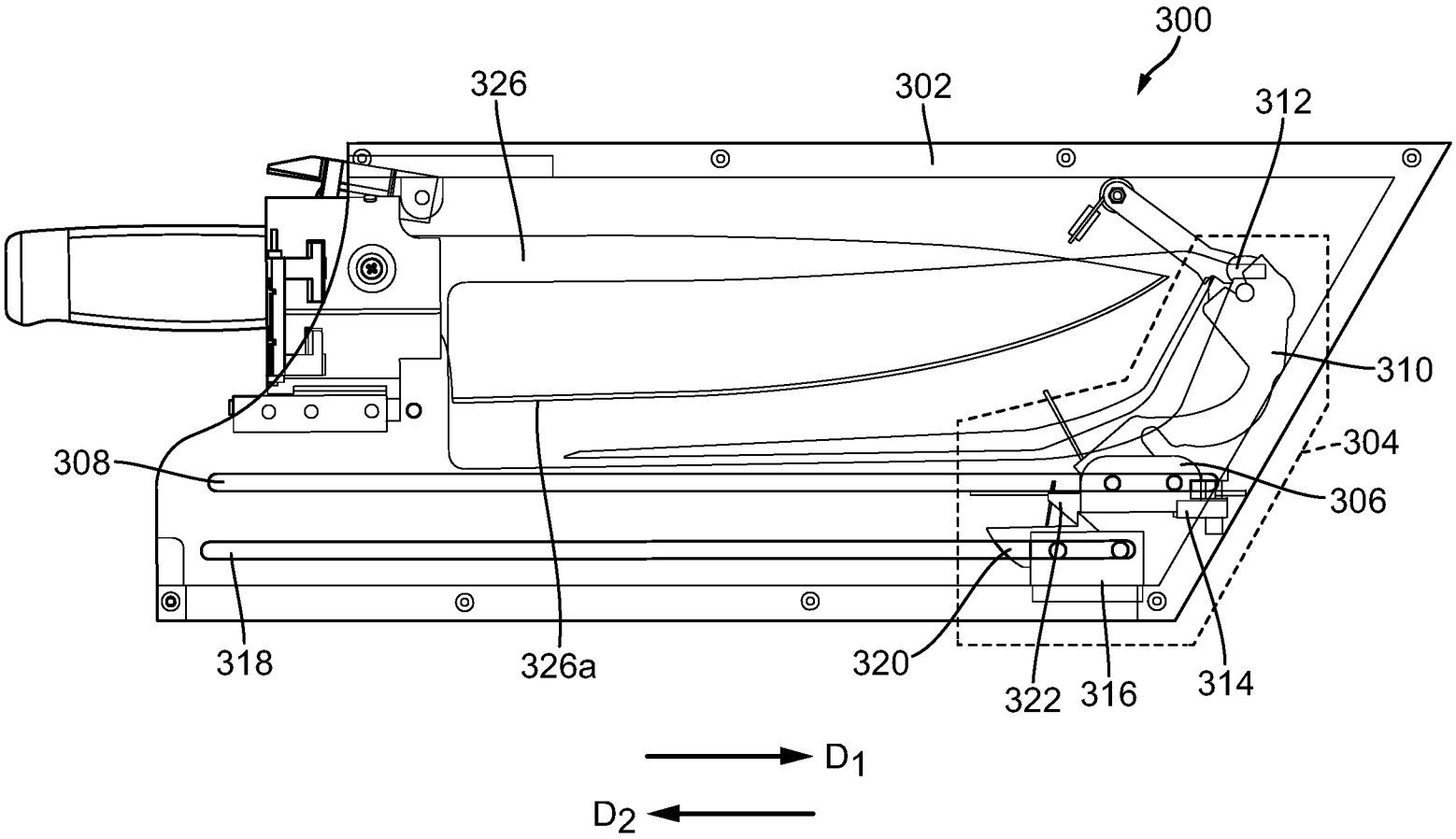
FIG. 11 is a side view of another exemplary knife sharpening system having primary and secondary carriages disposed therein, showing the primary and secondary carriages engaged with one another and in a first position.

The carriage assembly 304 also includes a secondary carriage 316 that is slidably disposed within a second guide track 318 that extends adjacent to and is parallel with the first guide track 308. The secondary carriage 316 includes a pawl 320 that is pivotally coupled thereto and is configured to engage with a catch flange 322 extending outward from the primary carriage 306. While not shown, a handle is coupled to the secondary carriage 316 and is configured to be actuated by a user. In use, when the secondary carriage 316 is engaged with the primary carriage 306, as shown in FIG. 11, a user can move (e.g., pull) the handle in a second direction $D_2$ (e.g., a proximal direction) that is opposite the first direction. As a result, the primary carriage 306 is pulled away from its home position against the force of the constant-force spring 314 to a preloaded position shown in FIG. 12. As shown, this also causes the constant-force spring 314 to partially unwind to an extended position. Further, while the primary carriage 306 is being moved to its preloaded position, the arm moves along the return track 324. As a result, the sharpening element 312 is prevented from contacting the cutting edge 326*a* of the knife blade 326 that is disposed within the housing 302.

Figure 13:
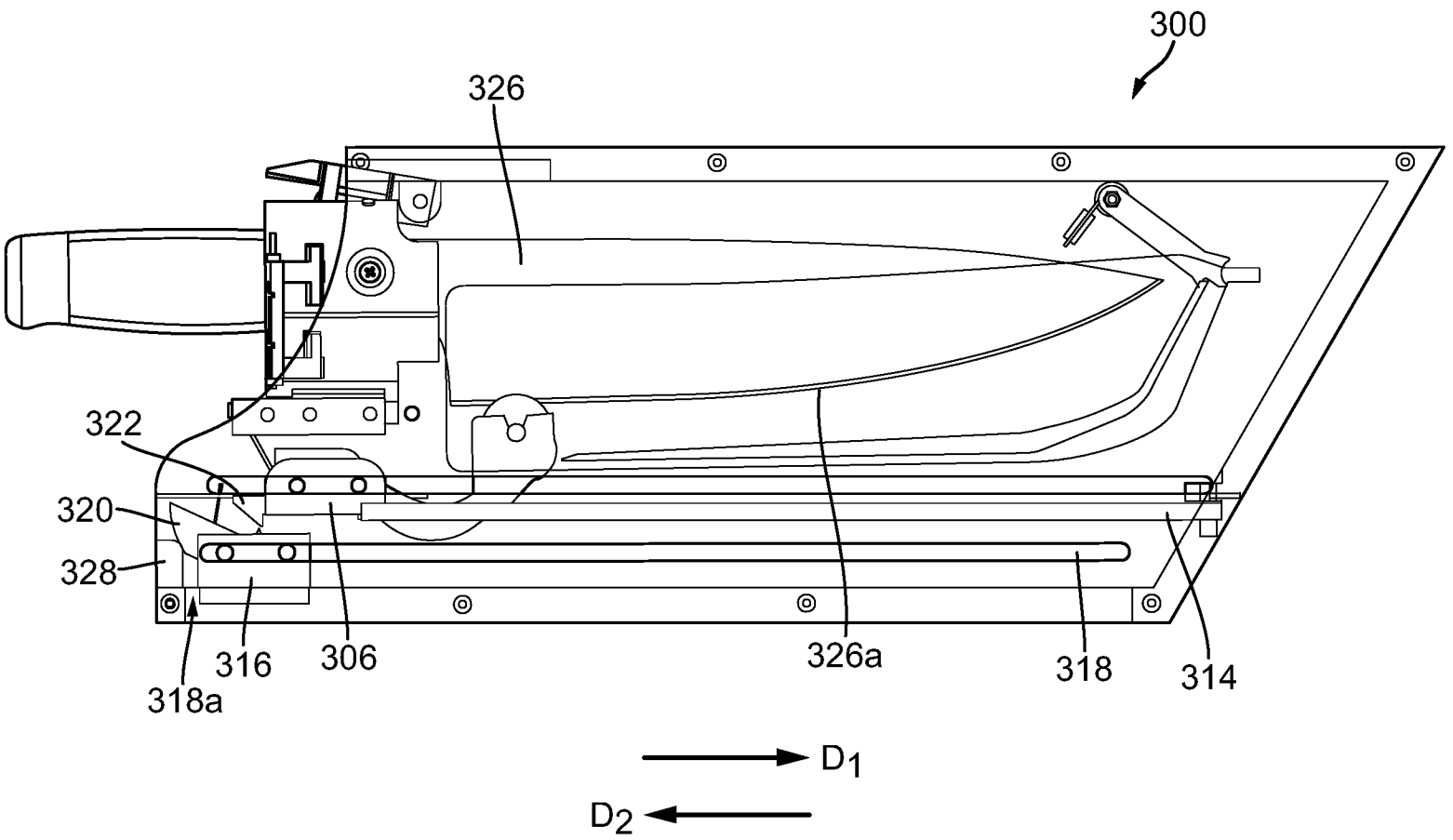
FIG. 13 is a side view of the knife sharpening system of FIG. 12, showing the primary and secondary carriages disengaged from one another.
Figure 14:
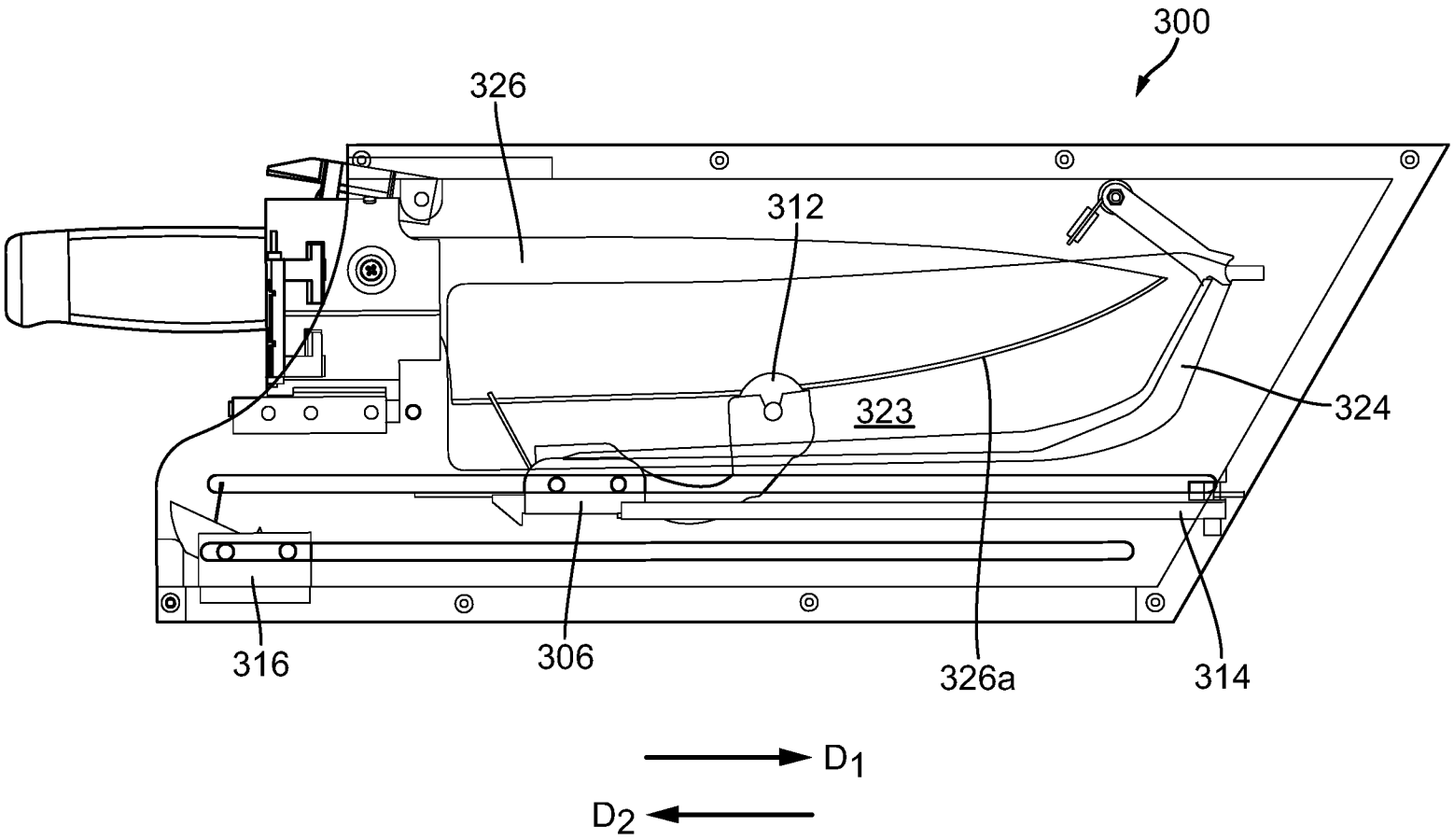
FIG. 14 is a side view of the knife sharpening system of FIG. 13, showing the primary and secondary carriages disengaged with one another and showing the primary carriage in a third position.
Figure 15:
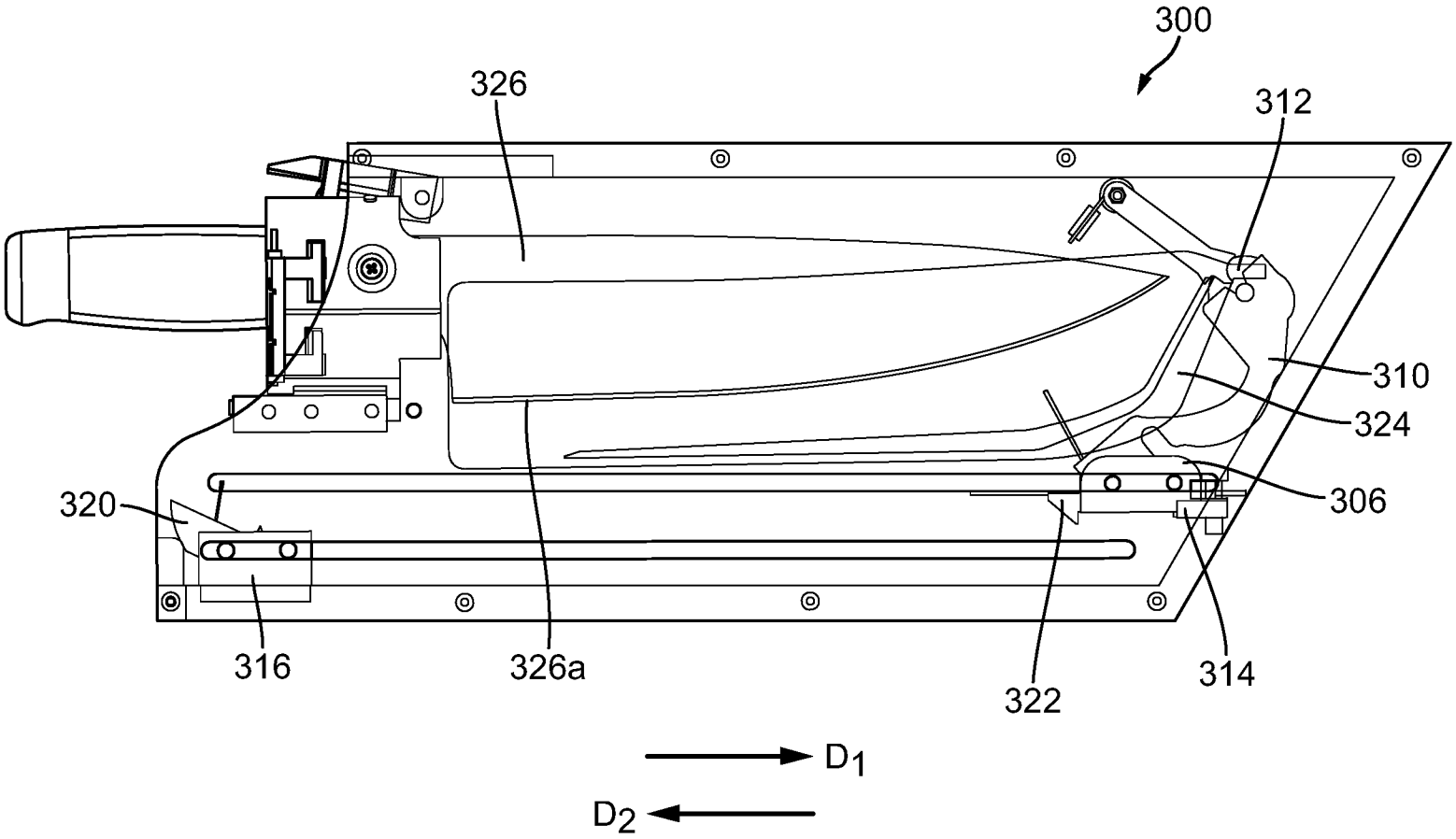
FIG. 15 is a side view of the knife sharpening system of FIG. 14, showing the primary and secondary carriages disengaged with one another and showing the primary carriage in the first position.

Once the secondary carriage 316 reaches a predetermined position (e.g., its proximal-most position within the second guide track 318), the pawl 320 engages a cam surface 328 at the proximal end 318*a* of the second guide track 318, as shown in FIG. 13. This interaction causes the pawl 320 to pivot (e.g., rotate in a clockwise direction) and disengage the catch flange 322 of the primary carriage 306. As such, the secondary carriage 316 automatically releases the primary carriage 306. Once released, the primary carriage 306 is pulled along the first guide track 308 in the first direction $D_1$ at a substantially constant speed under the force of the constant-force spring 314 (FIG. 14) until the primary carriage 306 reaches its home position (FIG. 15). Further, as shown in FIG. 14, as the primary carriage 306 is being pulled in the first direction $D_1$ under the force of the constant-force spring 314, the arm 310 moves at a substantially constant speed along the first track 323. As a result, the sharpening element 312 can repeatedly provide a substantially constant force to the cutting edge 326*a* of the knife blade 326 at a substantially constant speed.

Figure 12:
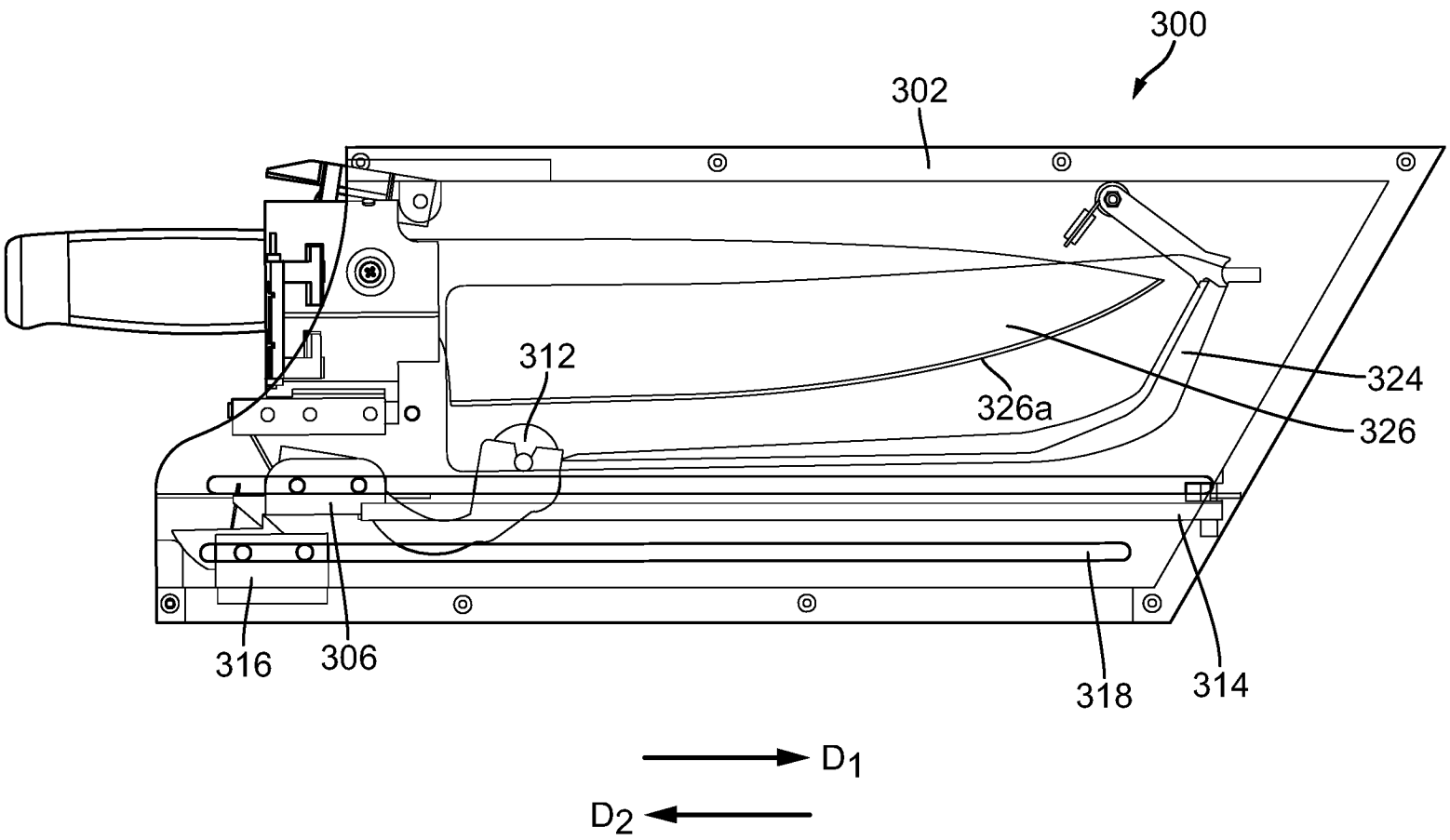
FIG. 12 is a side view of the knife sharpening system of FIG. 11, showing the primary and secondary carriages engaged with one another and in a second position.

In this illustrated embodiment, the constant-force spring 314 not only controls the speed of advancement of the sharpening element 312 in the first direction, but also, in combination with the secondary carriage 316, inhibits the sharpening element 312 from sharpening the cutting edge 326*a* of the knife blade 326 when moved in a second opposite direction. As a result, this can prevent the carriage assembly 304 from jamming during use, and therefore can function as an anti-jamming mechanism. For example, after the primary carriage 306 returns to its home position (FIG. 15), and additional sharpening is desired, the user will have to reengage the secondary carriage 316 with the primary carriage 306 and move the primary carriage 306 back to its preloaded position (FIG. 12). When the primary carriage 306 is in the home position, the sharpening element 312 is positioned within the return track 324 (FIGS. 11 and 15). Thus, once the secondary carriage 316 reengages with the primary carriage 306, the sharpening element 312 will be spaced apart a distance from the cutting edge 326*a* of the knife blade 326 while the user moves the primary carriage 306 back into the preloaded position (FIG. 12).

Figure 16:
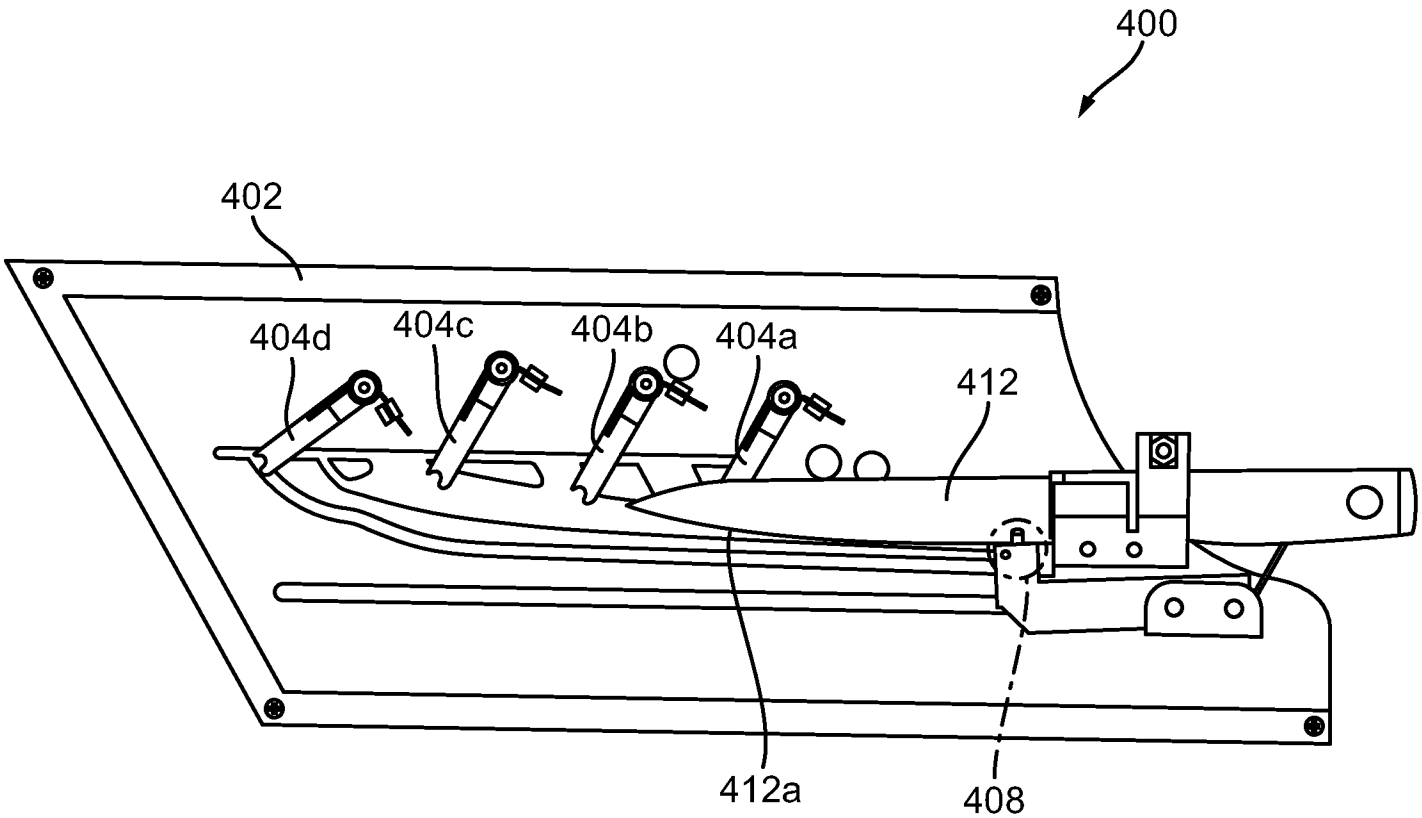
FIG. 16 is a side view of another exemplary embodiment of a knife sharpening system.

Another exemplary embodiment of a knife sharpening system 400 with an anti-jamming mechanism is illustrated in FIG. 16. Aside from the differences described below, the knife sharpening system 400 is similar to the knife sharpening system 100 in FIGS. 1-9, and therefore common features are not described in detail herein. Further, for purposes of simplicity, certain components of the knife sharpening system 400 are not illustrated in FIG. 16. As shown, the knife sharpening system 400 includes a housing 402 having multiple pawls 404*a*, 404*b*, 404*c*, 404*d* pivotally coupled thereto and spaced apart at different intervals along a first track. In use, once the sharpening element 408 has moved in a first direction (e.g., distal direction) along the length of a knife blade 412 disposed within the housing 402, the sharpening element 408 can engage the next upcoming pawl so that it can be switched into a return track that is different than the first track. As such, the sharpening element 408 can move to a return track based on the length of the knife blade 412. The return track can be configured to prevent the sharpening element 408 from contacting the knife blade when the sharpening element 408 is being moved in a second direction (e.g., a proximal direction) that is opposite the first direction. This can help minimize the risk of a user moving the sharpening element 408 in a second direction while it is still in the first track.

Figure 17A:
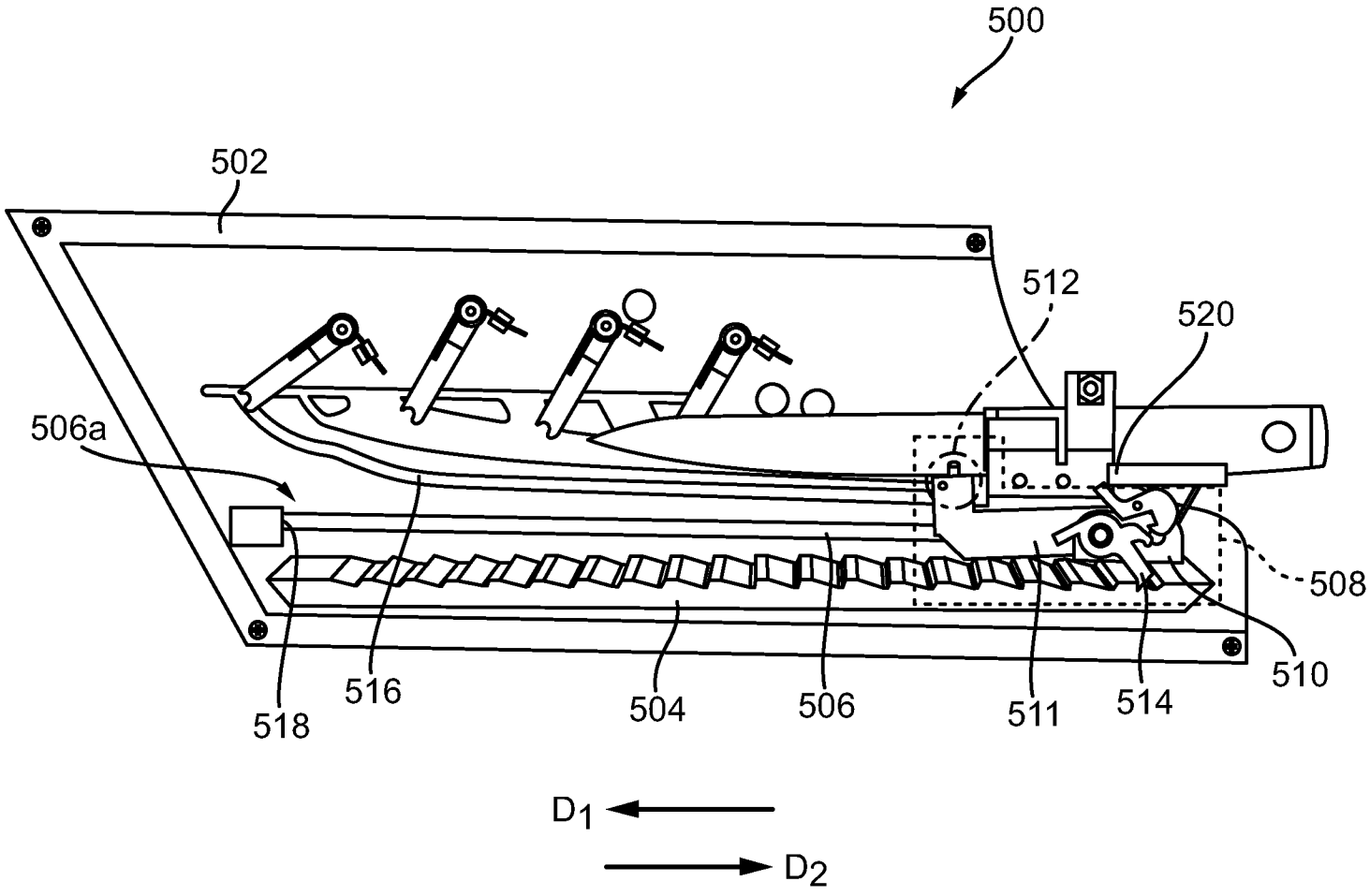
FIG. 17A is a side view of another exemplary embodiment of a knife sharpening system having a carriage assembly, showing the carriage assembly in a first position.
Figure 17B:
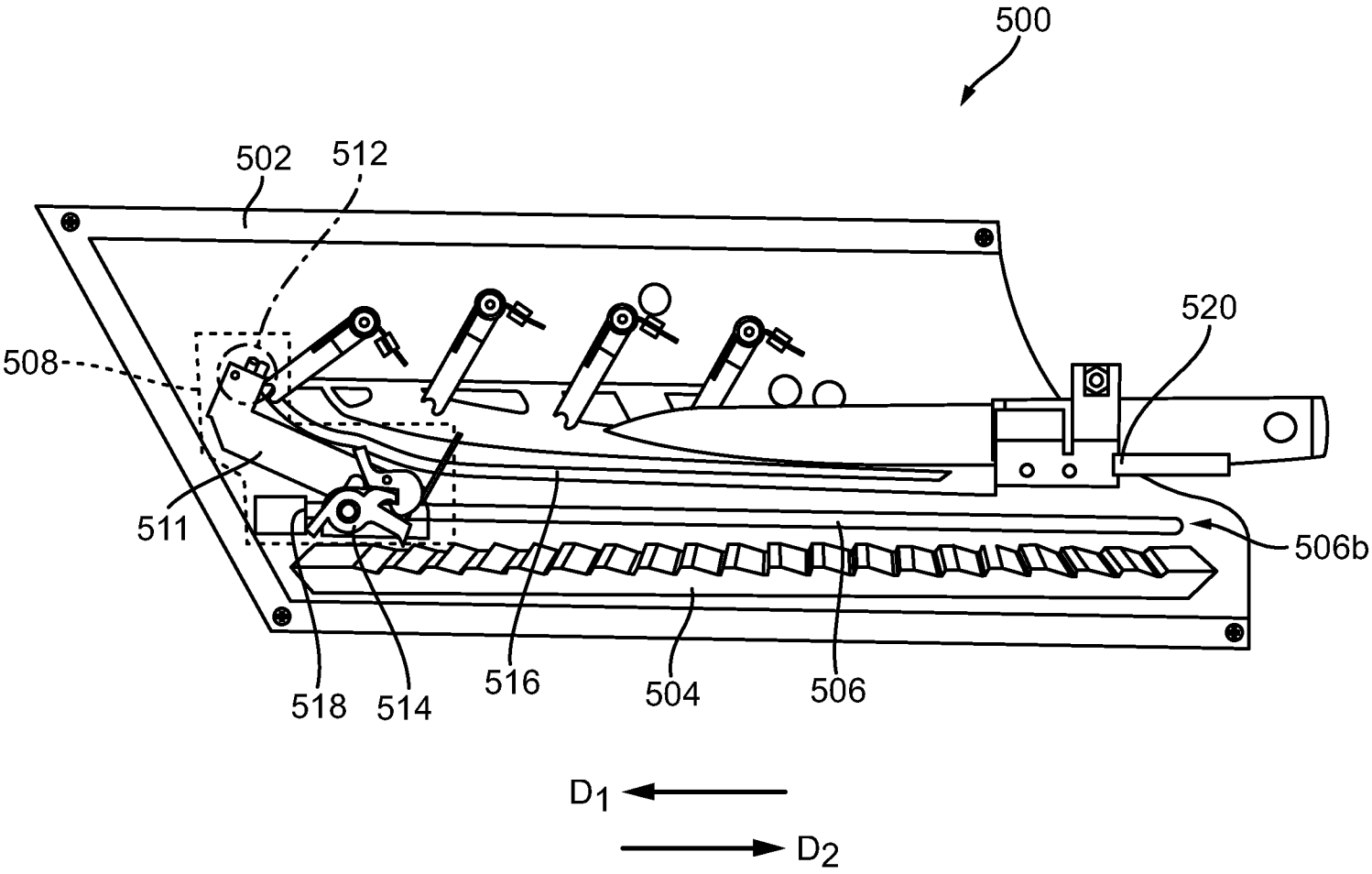
FIG. 17B is a side view of the knife sharpening system of FIG. 17A, showing the carriage assembly in a second position.

Another exemplary embodiment of a knife sharpening system 500 with an anti-jamming mechanism is illustrated in FIGS. 17A-17B. Aside from the differences described below, the knife sharpening system 500 is similar to the knife sharpening system 100 in FIGS. 1-9, and therefore common features are not described in detail herein. Further, for purposes of simplicity, certain components of the knife sharpening system 500 are not illustrated in FIGS. 17A-17B. As shown, the knife sharpening system 500 includes a housing 502 with a longitudinal array of ratchet teeth 504 disposed therein and extending adjacent to and parallel with the guide track 506 defined within the housing 502. The knife sharpening system 500 also includes a carriage assembly 508 having a carriage 510, a sharpening element 512 pivotally coupled to the carriage 510 via an arm 511, and a ratchet pawl 514 pivotally coupled to the carriage 510 and configured to move between engaged and disengaged positions. The carriage assembly 508 is movable along the guide track 506, which extends from a first end 506*a* (e.g., proximal end) to a second end 506*b* (e.g., distal end).

In use, when the ratchet pawl 514 is in an engaged position, the ratchet pawl 514 engages with the ratchet teeth 504 such that the carriage assembly 508, and thus the sharpening element 512, can only move in a first direction $D_1$ (e.g., a distal direction). Once the carriage assembly 508 reaches its distal-most position within the guide track 506 (FIG. 17B), the sharpening element 512 moves into the return track 516. Further, the ratchet pawl 514 engages with a cam surface at the second end 506*b* of the guide track 506 (FIG. 17B) which causes the ratchet pawl 514 to pivot and move into a disengaged position. When in the disengaged position, the carriage assembly 508 can then be moved in a second, opposite direction $D_2$ (e.g., a proximal direction). Once the carriage assembly 508 reaches its proximal-most position within the guide track 506 (FIG. 17A), a secondary pawl 518 engages with a cam surface 520 at the first end 506*a* of guide track 506 (e.g., the beginning of the longitudinal slot) which causes the ratchet pawl to pivot and reengage with ratchet teeth 504. As such, this ratchet design inhibits a user from moving the carriage assembly 508 in the second direction $D_2$ without the sharpening element 512 being positioned within the return track 516.

Figure 18A:
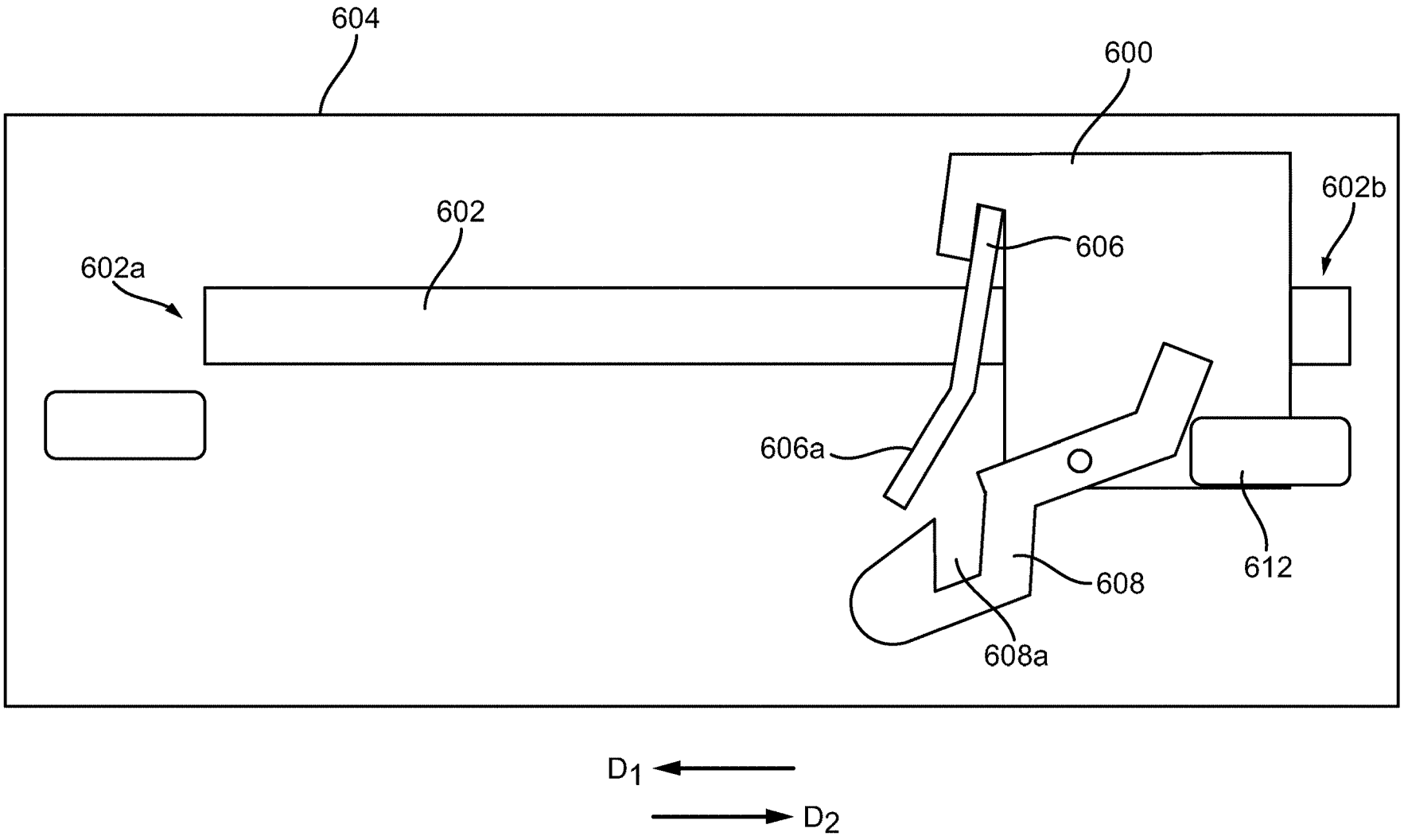
FIG. 18A is a schematic illustration of an exemplary embodiment of a friction locking mechanism, showing the friction locking mechanism in an engaged configuration.
Figure 18B:
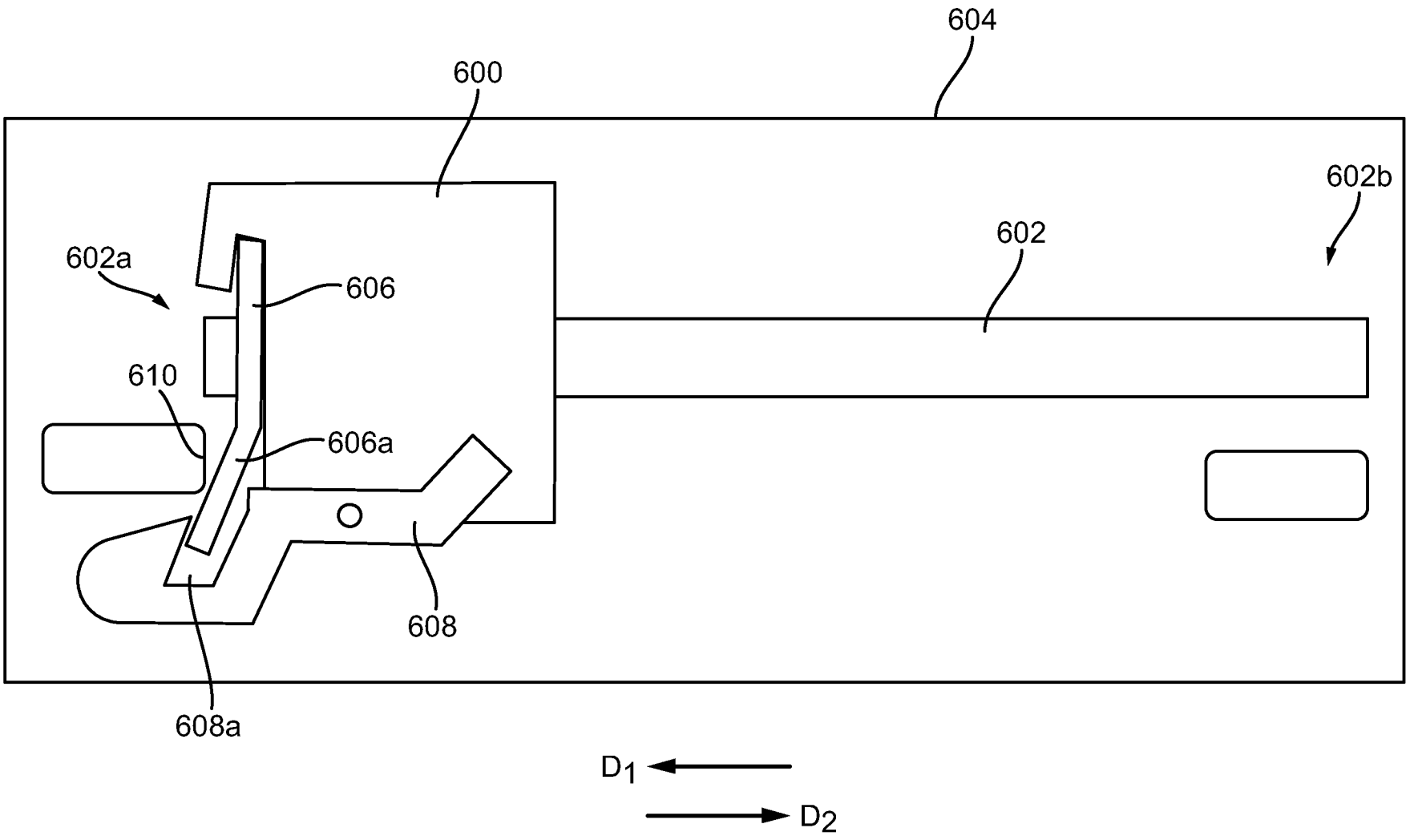
FIG. 18B is a schematic illustration the friction locking mechanism of FIG. 18A, showing the friction locking mechanism in a disengaged configuration.

In other embodiments, a friction lock mechanism can be used as an anti-jamming mechanism. For example, as schematically illustrated in FIGS. 18A-18B. a carriage 600 is slidably coupled to a guide rail 602 that positioned within a housing 604, and a lever 606 and a pawl 608 are each pivotally coupled to the carriage 600. The lever 606 is configured to move between an engaged mode (FIG. 18A) and a disengaged mode (FIG. 18B). When the lever 606 is in an engaged mode, the lever 606 frictionally engages the guide rail 602 such that the carriage 600 can only move in a first direction $D_1$ (e.g., a distal direction). When in a disengaged mode, the lever 606 is prevented from frictionally engaging with the guide rail 602, thereby allowing the carriage 600 to move in a second, opposite direction $D_Z$ (e.g., a proximal direction). In use, as the carriage 600 approaches a distal end 602*a* of the guide rail 602, a bottom portion 606*a* of the lever 606 engages with a first cam surface 610 that pushes the lever 606 into a groove 608*a* of the pawl 608. As a result, the lever 606 is pivoted counterclockwise and moves into the disengaged mode. When the carriage 600 moves along the guide rail 602 in the second direction $D_2$ and approaches a proximal end 602*b* of the guide rail 602, the pawl 608 engages with a second cam surface 612 that causes the pawl 608 to pivot in a counterclockwise direction. This counterclockwise rotation releases the lever 606 from the groove 608*a* and allows the lever 606 to pivot back towards and frictionally reengage the guide rail 602.

In some embodiments, the knife sharpening system can be configured to allow the user to access the sharpening element (e.g., for purposes of switching, repairing, or replacing the sharpening element). FIGS. 19A-19D illustrate an exemplary embodiment of a knife sharpening system 700 having an access door 702 that is configured to provides access to the sharpening element 718. Aside from the differences described below, the knife sharpening system 700 is similar to the knife sharpening system 300 in FIGS. 11-15, and therefore common features are not described herein.

Figure 19A:
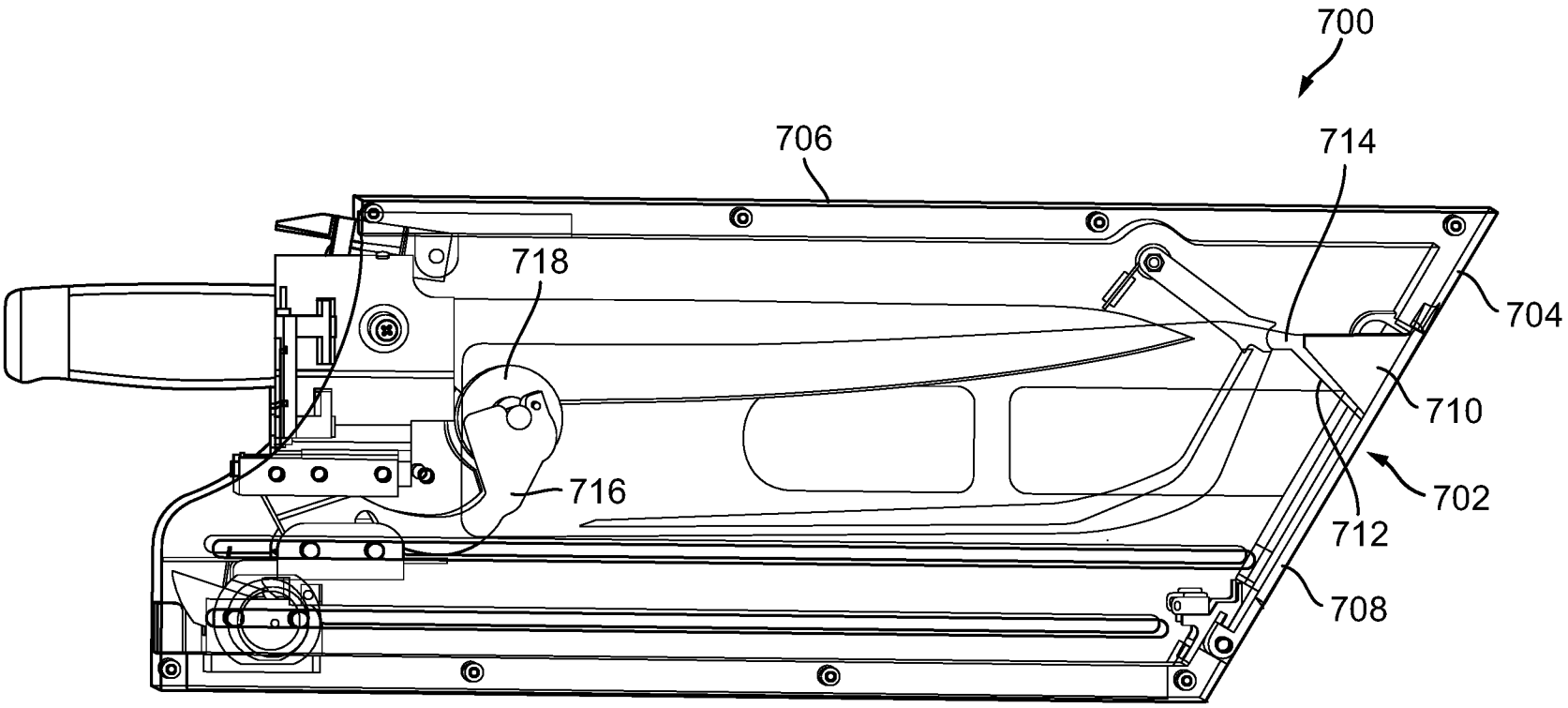
FIG. 19A is a side partially transparent view of another exemplary knife sharpening system having an access door.
Figure 19B:
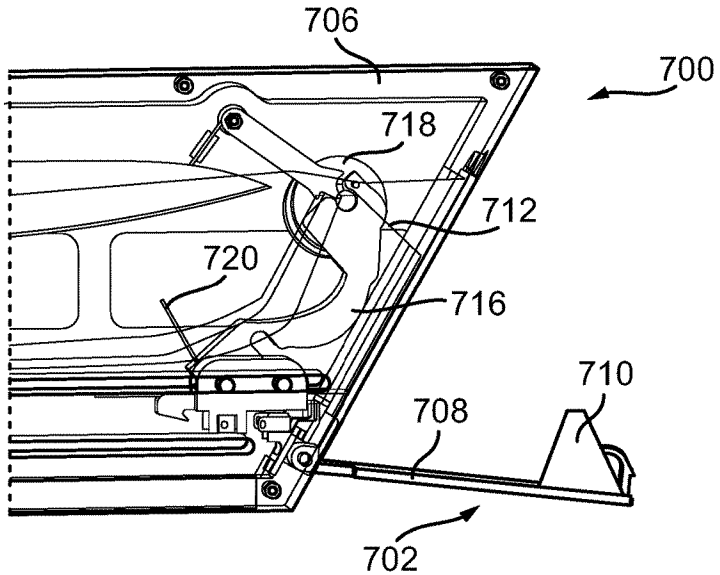
FIG. 19B is a side partially transparent view of an end portion of the knife sharpening system of FIG. 19A, showing the access door in an open position.
Figure 19C:
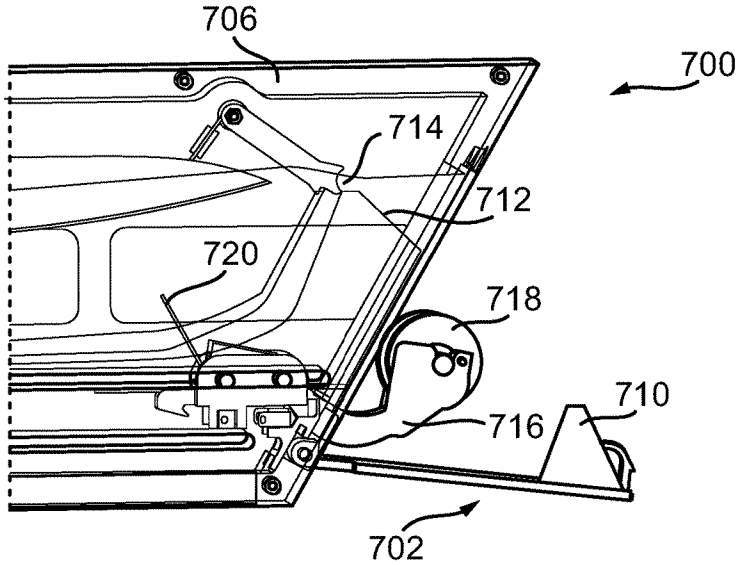
FIG. 19C is a side partially transparent view of an end portion of the knife sharpening system of FIG. 19A, showing the access door in an open position.
Figure 19D:
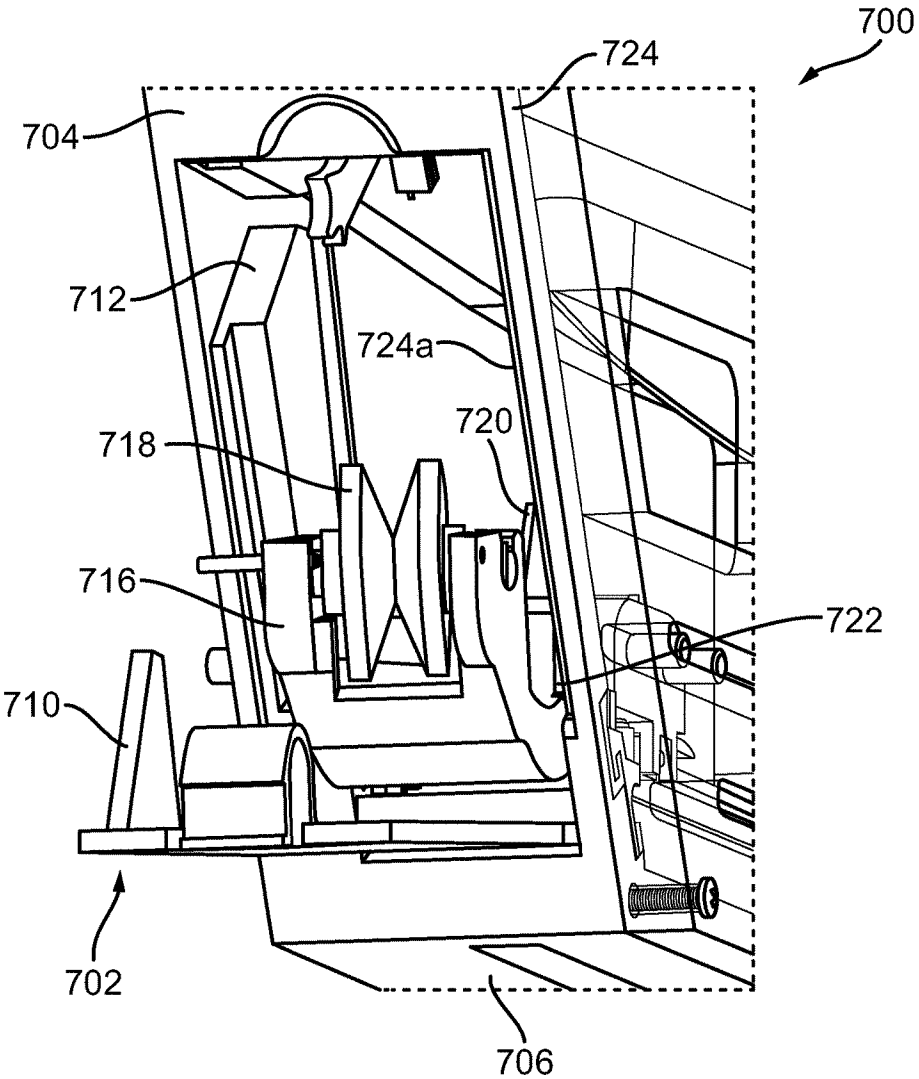
FIG. 19D is a bottom partially transparent view of an end portion of the knife sharpening system of FIG. 19A, showing the access door in an open position.

As shown, the access door 702 is pivotally coupled to a base portion 704 of the housing 706. The access door 702 has a planar base member 708 with a triangular protrusion 710 extending therefrom. When the access door 702 is in a closed position (FIG. 19A), the protrusion blocks a cam path 712 that extends from the end of the first track 714 and out towards the base portion 704 of the housing 706. When the access door 702 is in an open position (FIGS. 19B-19D) the cam path 712 is no longer blocked, thereby allowing the arm 716 and the sharpening element 718 to travel along the cam path 712 and ultimately pivot outward from the housing 706 (FIGS. 19C-19D). Since the arm 716, and thus the sharpening element 718, are biased towards the housing 706 by a biasing element 720 (e.g., via a torsion spring), a ramp feature 722 extends outward from a portion of an inner surface 724*a* of a back panel 724 of the housing 706. This ramp feature 722 engages with and stabilizes the arm 716 while the user repairs or replaces the sharpening element 718. Once the sharpening element 718 has been repaired or replaced, a user can disengage the arm 716 from the ramp feature 722 to thereby allow the arm 716 and sharpening element 718 to pivot back into the housing 706 (e.g., rotate in a counterclockwise direction) and ride back up along the cam path 712 and into the first track 714. The user can then close the access door 702 so that the knife sharpening system 700 is ready for use.

As indicated above, the knife sharpening systems disclosed herein can provide controlled and reproducible sharpening strokes along a cutting edge of a blade of the knife during each use, regardless of the shape of the knife. Various features of these knife sharpening systems can aid in achieving a desired sharpness of the cutting edge, which consumer testing indicates should be below 300 g based on the Brubacher Edge Sharpness Scale (BESS). For example, the force of the spring-biased sharpening element against the blade can help a user consistently and easily sharpen the cutting edge and without the need for complicated electronics or sensors. While the force can vary depending on the structural configuration of the knife sharpening assembly, in certain exemplary embodiments the spring force of the spring coupled to the arm having the sharpening element thereon is in the range of 0.25 to 2 Kg. The controlled speed of translation of the carriage assembly along the guide track, e.g., using a constant force spring, as well as the number of sharpening strokes being employed during a sharpening process, can also aid in achieving consistent and desired sharpness. Other factors that may affect performance include the wheel sharpener grit, material, geometry, and angle that it is held in the housing.

In the present disclosure, like-named components of the embodiments generally have similar features, and thus within a particular embodiment each feature of each like-named component is not necessarily fully elaborated upon. Additionally, to the extent that linear or circular dimensions are used in the description of the disclosed knife sharpeners and methods, such dimensions are not intended to limit the types of shapes that can be used in conjunction with such knife sharpeners and method. A person skilled in the art will recognize that an equivalent to such linear and circular dimensions can easily be determined for any geometric shape.

It will be appreciated that the terms "proximal" and "distal" are used herein with reference to a user, such as a consumer, gripping a handle of the knife sharpening system. Other spatial terms such as "front" and "rear" similarly correspond respectively to distal and proximal. It will be further appreciated that for convenience and clarity, spatial terms such as "vertical" and "horizontal" are used herein with respect to the drawings. However, the knife sharpening systems can be used in many orientations and positions, and these spatial terms are not intended to be limiting and absolute.

Values or ranges may be expressed herein as "about" and/or from/of "about" one particular value to another particular value. When such values or ranges are expressed, other embodiments disclosed include the specific value recited and/or from/of the one particular value to another particular value. Similarly, when values are expressed as approximations, by the use of antecedent "about," it will be understood that here are a number of values disclosed therein, and that the particular value forms another embodiment. It will be further understood that there are a number of values disclosed therein, and that each value is also herein disclosed as "about" that particular value in addition to the value itself. In embodiments, "about" can be used to mean, for example, within 10% of the recited value, within 5% of the recited value or within 2% of the recited value.

For purposes of describing and defining the present teachings, it is noted that unless indicated otherwise, the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety. Any patent, publication, or information, in whole or in part, that is said to be incorporated by reference herein is only to the extent that the incorporated material does not conflict with existing definitions, statements, or other disclosure material set forth in this document. As such the disclosure as explicitly set forth herein supersedes any conflicting material incorporated herein by reference.

What is claimed is:

1. A knife sharpener system, comprising:

a housing configured to receive a knife blade at a proximal end thereof, the housing including a carriage assembly movably mounted thereto, the camage assembly being configured to travel along a guide track;

a sharpening element coupled to the carriage assembly and configured to sharpen a cutting edge of the knife blade, the sharpening element being movable relative to the housing along a first track to move along and against the cutting edge of the knife blade disposed in the housing, the first track being separate from the guide track; and an access door pivotally coupled to a distal end of the housing and configured to block a cam path extending from the first track when the access door is in a closed position, the access door being configured to allow access to the sharpening element to allow removal of at least a portion of the sharpening element, wherein the cam path is unblocked when the access door is in an open position.

2. The knife sharpener system of claim 1, wherein the access door has a base member with a protrusion extending therefrom.

3. The knife sharpener system of claim 2, wherein, when the access door is in the closed position, the protrusion is configured to prevent access to the sharpening element.

4. The knife sharpener system of claim 1, wherein the cam path that extends from an end of the first track and out towards a base portion of the housing, wherein, when the access door is open, the sharpening element is configured to travel along the cam path and pivot outward and away from the housing.

5. The knife sharpener system of claim 1, wherein the housing has a ramp feature that is configured to selectively engage and prevent the sharpening element from moving back into the housing when the access door is in the open position.

6. The knife sharpener system of claim 1, further comprising an arm moveably coupled to the housing, and wherein the sharpening element is disposed on the arm.

* * * * *